US009743758B2

(12) United States Patent
Johnson et al.

(10) Patent No.: US 9,743,758 B2
(45) Date of Patent: Aug. 29, 2017

(54) MODULAR WORKSURFACE SYSTEM

(71) Applicant: Haworth, Inc., Holland, MI (US)

(72) Inventors: Ross S. Johnson, Jenison, MI (US); Duane Danz, Grand Rapids, MI (US); Bryan R. Gingrich, Holland, MI (US); Dave Emery, Muskegon, MI (US); Todd Zeilinger, Holland, MI (US)

(73) Assignee: Haworth, Inc., Holland, MI (US)

( * ) Notice: Subject to any disclaimer, the term of this patent is extended or adjusted under 35 U.S.C. 154(b) by 0 days.

(21) Appl. No.: 15/353,789

(22) Filed: Nov. 17, 2016

(65) Prior Publication Data

US 2017/0065076 A1 Mar. 9, 2017

Related U.S. Application Data

(63) Continuation of application No. 14/711,152, filed on May 13, 2015, now Pat. No. 9,516,945.

(60) Provisional application No. 62/106,303, filed on Jan. 22, 2015.

(51) Int. Cl.

| | |
|---|---|
| ***A47B 37/00*** | (2006.01) |
| ***A47B 21/04*** | (2006.01) |
| ***A47B 83/00*** | (2006.01) |
| ***A47B 21/06*** | (2006.01) |
| ***A47B 87/00*** | (2006.01) |
| *A47B 1/04* | (2006.01) |

(52) U.S. Cl.

CPC ..... *A47B 21/04* (2013.01); *A47B 21/06* (2013.01); *A47B 83/001* (2013.01); *A47B 87/002* (2013.01); *A47B 1/04* (2013.01); *A47B 2021/062* (2013.01); *A47B 2021/066* (2013.01); *A47B 2200/0085* (2013.01); *A47B 2200/0088* (2013.01); *A47B 2200/12* (2013.01)

(58) Field of Classification Search

CPC ..... A47B 83/001; A47B 83/00; A47B 21/04; A47B 21/06; A47B 21/00; A47B 21/0314; A47B 87/002; A47B 2021/062; A47B 2021/064; A47B 2021/066; A47B 2021/008; H01R 27/02

USPC ..... 108/50.01, 50.02; 312/223.6, 223.1, 312/223.3

See application file for complete search history.

(56) References Cited

U.S. PATENT DOCUMENTS

| | | | |
|---|---|---|---|
| 3,027,214 | A | 3/1962 | Curatolo |
| 4,050,752 | A | 9/1977 | Dykstra |
| 4,163,592 | A | 8/1979 | Nelson |

(Continued)

*Primary Examiner* — Jose V Chen

(74) *Attorney, Agent, or Firm* — Warner Norcross & Judd LLP

(57) ABSTRACT

An improved worksurface for home and office furniture constructions. The improved worksurface generally includes a plurality of vertical openings disposed along at least a portion of the periphery of the worksurface, where the vertical openings are adapted to support removable and interchangeable accessories. The accessories can include shelving units, support stands, storage baskets, swivel arms, docking cradles, and display mounts, for example, each being positionable at multiple locations along the periphery of the worksurface. The vertical openings are optionally disposed within a recessed portion extending adjacent a rear edge of the worksurface. In use, a user can reposition the accessories as desired, providing enhanced flexibility and customization over existing constructions.

7 Claims, 37 Drawing Sheets

(56) References Cited

U.S. PATENT DOCUMENTS 4,174,668 A 11/1979 Thomas, Jr.
4,224,769 A 9/1980 Ball et al.
4,403,700 A 9/1983 Manlove
4,535,703 A 8/1985 Henriott et al.
4,687,167 A 8/1987 Skalka et al.
4,734,826 A 3/1988 Wilson et al.
4,783,036 A 11/1988 Vossoughi
4,787,595 A 11/1988 Hegarty
4,879,955 A 11/1989 Moll et al.
4,884,513 A 12/1989 Newhouse et al.
5,078,055 A 1/1992 Bellini et al.
5,092,253 A 3/1992 Grund et al.
5,237,935 A * 8/1993 Newhouse ..... A47B 21/06 108/50.02
5,272,988 A 12/1993 Kelley et al.
5,277,609 A * 1/1994 Ondrejka ..... A47B 21/06 439/211
5,318,454 A * 6/1994 Deer ..... A47B 21/06 29/869
5,473,994 A 12/1995 Foley et al.
5,486,042 A 1/1996 Heisler et al.
5,522,324 A * 6/1996 van Gelder ..... A47B 21/06 108/50.02
5,568,773 A 10/1996 Hung
5,611,608 A 3/1997 Clausen
5,640,912 A 6/1997 Diffrient
5,684,469 A * 11/1997 Toms ..... A47B 83/001 312/223.6
5,704,298 A 1/1998 Corpuz, Jr. et al.
5,752,449 A 5/1998 Simon et al.
5,881,500 A * 3/1999 Latino ..... A47B 21/06 52/220.7
5,931,103 A * 8/1999 Huang ..... A47B 17/065 108/26
5,971,508 A * 10/1999 Deimen ..... A47B 21/06 108/50.02
5,974,985 A 11/1999 Flototto et al.
6,062,149 A 5/2000 Duvivier et al.
6,062,518 A 5/2000 Etue
6,076,474 A 6/2000 Grabowski et al.
D431,026 S 9/2000 Berkowitz et al.
6,170,410 B1 1/2001 Gioacchini et al.
6,183,280 B1 * 2/2001 Laukhuf ..... A47B 21/06 439/214
6,196,648 B1 3/2001 Henriott
6,241,329 B1 * 6/2001 Nielsen ..... A47B 21/06 108/50.02
6,283,043 B1 * 9/2001 Stern ..... A47B 13/06 108/50.02
6,415,723 B1 7/2002 Kopish et al.
6,435,106 B2 8/2002 Funk et al.
6,457,422 B1 10/2002 Saul
6,491,268 B1 12/2002 Channer et al.
6,601,931 B1 8/2003 Schairbaum et al.
6,609,691 B2 8/2003 Oddsen, Jr.
6,647,900 B1 11/2003 Kopish
6,662,732 B2 12/2003 Birsel et al.
6,681,704 B1 1/2004 Brookhiser
6,725,784 B2 4/2004 Crinion
6,817,684 B2 11/2004 Cattaneo
6,857,610 B1 2/2005 Conner et al.
7,066,097 B2 6/2006 Gayhart et al.
7,264,212 B2 9/2007 Hung
7,278,360 B2 10/2007 Griepentrog
7,594,631 B1 9/2009 Carnevali
7,721,658 B2 5/2010 Seeley et al.
7,871,280 B2 * 1/2011 Henriott ..... A47B 21/06 108/50.02
7,942,100 B2 5/2011 Grove et al.
8,061,279 B2 11/2011 Preiss
8,087,738 B2 1/2012 Henriott et al.
8,109,215 B2 * 2/2012 Kitada ..... A47B 21/00 108/50.02
8,162,271 B2 4/2012 Li
8,196,526 B2 * 6/2012 Rheault ..... A47B 13/10 108/50.01
8,276,523 B2 * 10/2012 Miller ..... A47B 21/00 108/50.02
RE43,921 E 1/2013 Smed
8,366,060 B2 2/2013 Hung
8,469,323 B1 6/2013 Deros et al.
8,665,584 B2 3/2014 Pence
8,701,568 B2 * 4/2014 Miller ..... A47B 21/00 108/50.02
8,740,165 B2 6/2014 O'Kasick et al.
9,516,945 B2 * 12/2016 Johnson ..... A47B 21/04
2002/0079789 A1 6/2002 Grubb et al.
2004/0097135 A1 * 5/2004 Brooks ..... A47B 21/06 439/607.01
2005/0006542 A1 1/2005 Henning et al.
2005/0022699 A1 * 2/2005 Goza ..... A47B 21/0314 108/50.01
2005/0284341 A1 12/2005 Klassy et al.
2006/0063424 A1 * 3/2006 Grundon ..... A47B 21/06 439/535
2007/0040084 A1 2/2007 Sturman et al.
2007/0235222 A1 10/2007 Hubbard
2007/0278361 A1 12/2007 May et al.
2010/0024688 A1 * 2/2010 Kitada ..... A47B 21/00 108/50.02
2010/0288168 A1 * 11/2010 Rheault ..... A47B 13/10 108/28
2011/0036276 A1 2/2011 Petrick et al.
2011/0048288 A1 3/2011 Sheldon
2012/0006767 A1 1/2012 Bennett et al.
2012/0080565 A1 4/2012 Gallup
2013/0306820 A1 11/2013 Sapper et al.
2014/0138506 A1 5/2014 Dahl et al.
2015/0173505 A1 * 6/2015 Mirth ..... A47B 13/16 211/186
2015/0245707 A1 * 9/2015 Saab ..... A47B 21/03 108/25

* cited by examiner

MODULAR WORKSURFACE SYSTEM

BACKGROUND OF THE INVENTION

The present invention relates to worksurfaces and, more particularly, to worksurfaces that support storage accessories, desk wire trays, technology tools and privacy panels.

Many office furniture constructions include a rigid worksurface capable of supporting various devices, such as computers and telephones. These worksurfaces can sometimes include pass-through-holes for power cables and telephone cables. Cabinets, shelving, and privacy panels are sometimes supported above the worksurface, and drawers, shelving, and modesty panels are sometimes supported below the worksurface. Many conventional office furniture constructions also include free-standing units such as file cabinets that are arranged for access below the worksurface.

In the above described constructions, the drawers, shelves, and privacy panels are typically located in predesignated locations on or above the worksurface. In these one-size-fits-all constructions, the user is generally limited to the locations designated by the manufacture without regard to individual preferences. In existing constructions that do allow for repositioning of the drawers, shelves, and privacy panels, the task of repositioning these objects can require complicated steps and tooling, discouraging the actual customization of the workspace for the user.

Many existing office furniture constructions are also poorly suited to support technology tools. For example, electronic devices such as smartphones, tablets, and LCD displays typically benefit from respective cradles, stands, and mounts. However, existing cradles, stands and mounts might not be interchangeable. In addition, the existing cradles, stands and mounts might not suit each user's preferences. For example, the height of a given cradle, stand or mount might be suitable for some users, while being unsuitable for other users. In addition, the placement of cradles, stands or mounts might be confined to a particular location on or above the worksurface, with little or no variability.

SUMMARY OF THE INVENTION

An improved worksurface is provided. The improved worksurface generally includes a plurality of openings and a plurality of retention slots disposed along at least a portion of the periphery of the worksurface, where the openings and the retention slots are adapted to support interchangeable accessories and privacy panels. The openings and the retention slots are optionally disposed within a recessed portion of the worksurface that extends adjacent a rear edge of the worksurface. In use, a user can reposition the accessories as desired, optionally without the use of tooling, thereby providing enhanced flexibility and customization over existing constructions.

In one embodiment, the worksurface includes a plurality of vertical openings and a plurality of vertical retention slots. The vertical openings are adapted to receive a downward extending post from an accessory, and the vertical retention slots are adapted to receive a downward extending retention clip from either of an accessory or a privacy panel. The worksurface can include additional openings and retention slots adjacent to the side edge of the worksurface. The openings and retention slots generally border the outer periphery of the worksurface in a repeating pattern that carries over onto adjacent worksurfaces, such as adjacent desks and adjacent side tables.

In another embodiment, a worksurface system includes a first worksurface, for example a desk, and a second worksurface, for example a side table. The first and second worksurfaces each include a plurality of openings and retention slots to support interchangeable accessories and privacy panels. The first and second worksurfaces are positionable in a plurality of orientations with respect to each other to provide a plurality of workspace configurations. For example, the first and second worksurfaces can be positionable in end-to-end relationship, an end-to-side relationship, and a side-to-side relationship. These orientations can provide a general alignment of the openings and the retention slots of the first worksurface with the openings and the retention slots of the second worksurface. That is, each of the first and second worksurfaces includes a repeating pattern of openings and retention slots, such that the repeating pattern carries over from the first worksurface to the second worksurface.

In another embodiment, a system includes a privacy panel that is supported by first and second furniture units. The privacy panel includes a first retention clip for insertion into a retention slot in the first furniture unit, and the privacy panel includes a second retention clip for insertion into a retention slot in the second furniture unit. The privacy panel is offset rearwardly with respect to the retention slots, such that the privacy panel does not overlie the retention slots in the respective worksurfaces. The privacy panel is positioned above the worksurface, however, being generally flush with the back edge of the worksurface. The worksurfaces are adapted to support a plurality of accessories, including for example elevated shelving units, elevated support stands, side baskets, and docking cradles for smartphones, tablets and other devices.

In another embodiment, a desk wire tray is provided. The desk wire tray includes a wire management channel that is positionable beneath a worksurface. The wire management channel includes a bottom panel and first and second side panels that are removably coupled to the worksurface about first and second hinged connections, respectively. The wire management channel is adapted to be selectively pivoted about the first hinged connection and about the second hinged connection to provide dual-sided access to the wire management channel from beneath the worksurface.

In another embodiment, the accessories include modular support accessories for a plurality of technology tools, referred to as electronic devices herein. The modular support accessories include a post that fits within the vertical openings in the worksurface, a first swivel arm connected to the post, a second swivel arm connected to the first swivel arm, and a plurality of device mounts, wherein each of the plurality of device mounts are attachable to the plurality of vertical openings, the first swivel arm, and the second swivel arm to provide a plurality of placement options for the device mounts. The device mounts include a cradle, a stand, or a mounting plate, and the electronic devices include a smartphone, a tablet, a monitor, or a laptop. The first and second swivel arms include a downward extending pivot post at one end thereof and an upward extending socket at the other end thereof. The second swivel arm rests against the first pivot arm between uses, and includes internal cabling apertures for cabling extending to and from the electronic devices.

These and other advantages and features of the invention will be more fully understood and appreciated by reference to the description of the current embodiments and the drawings.

DESCRIPTION OF THE CURRENT EMBODIMENTS

The current embodiments relate to an improved worksurface system for home and office furniture constructions. In these embodiments, the improved worksurface system is configured to support a plurality of accessories and privacy panels, optionally in conjunction with adjacent worksurfaces of the same or similar construction.

Figure 1:
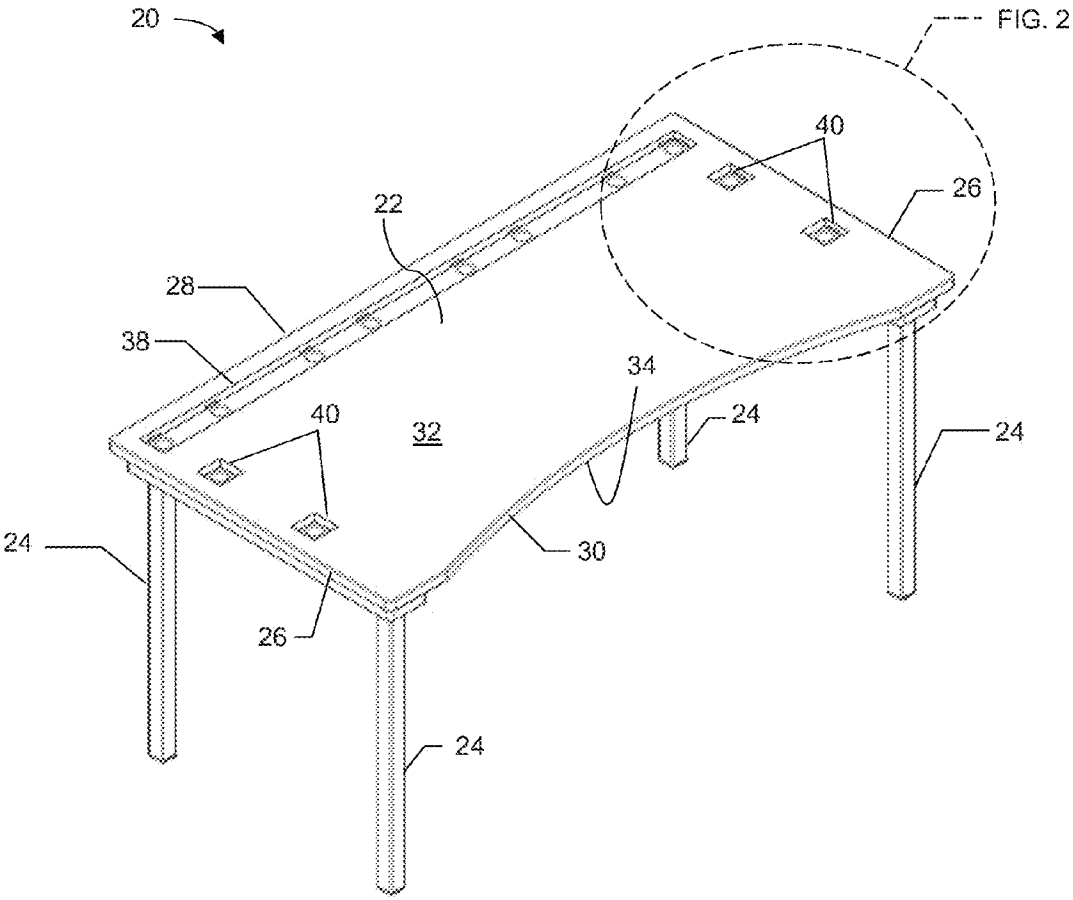
FIG. 1 is a perspective view of a desktop worksurface in accordance with one embodiment of the present invention.
Figure 2:
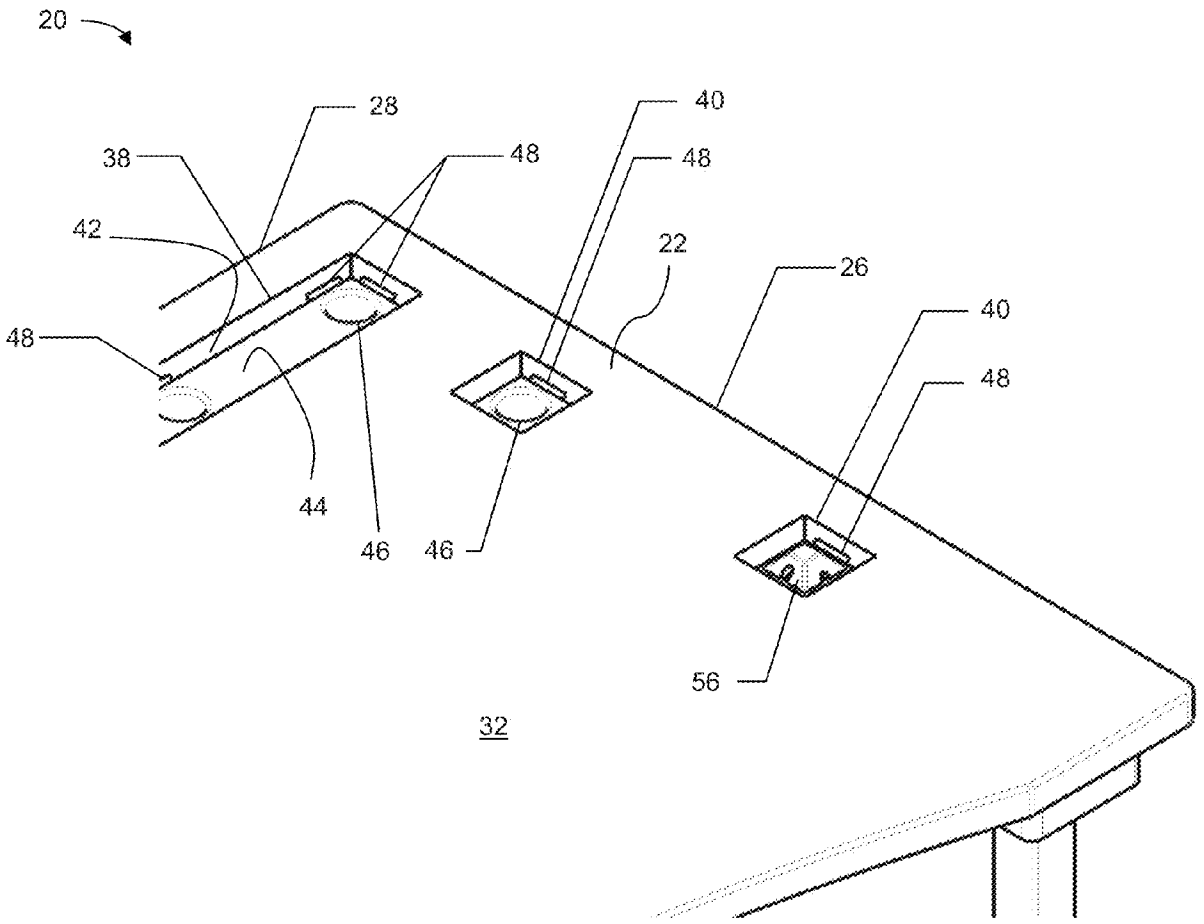
FIG. 2 is close-up view of the desktop worksurface of FIG. 1.

Referring now to FIGS. 1 and 2, a furniture unit in accordance with one embodiment is illustrated and generally designated 20. The furniture unit 20 includes a worksurface 22 and a plurality of support legs 24, shown in the figures as four support legs. The worksurface 22 is formed of any suitable material, for example plastic, metal, wood, or fiberglass. The worksurface 22 includes a thickness, a length, a width, and a periphery that cooperate to define the overall shape of the worksurface 22. In the illustrated embodiment, the periphery includes left and right side edges 26, a rear edge 28, and a front edge 30. The worksurface 22 is generally rectangular in FIG. 1, having a recessed or concave front edge 30, but can include other shapes as desired.

As also shown in FIGS. 1 and 2, the worksurface 22 includes an upper surface 32 opposite of a lower surface 34. The upper surface 32 includes one or more recesses 38, 40 that depend downwardly from the upper surface 32. In other embodiments the upper surface 32 is free or substantially free of any recesses. Where recesses are included, the upper surface 32 can include a rear recess 38, one or more side recesses 40, only a rear recess 38, or only one or more side recesses 40. The rear recess 38 extends in the lengthwise direction adjacent to the rearward edge 28, and the one or more side recesses 40 are adjacent a side edge 26 of the worksurface 22. As perhaps best shown in FIG. 2, each recess 38, 40 includes one or more sidewalls 42 and a base 44. The sidewalls 42 interconnect the base 44 to the upper surface 32. The sidewalls 42 are angled in the present embodiment, but can be upright, beveled, or curved for example in other embodiments. The base 44 is optionally parallel to, but recessed from, the upper surface 32.

Referring to FIG. 2, the recesses 38, 40 include one or more vertical openings 46. These openings 46 are accessible from the top of the worksurface 22, and extend partially through the remaining thickness of the worksurface 22. The openings 46 are shaped to telescopically receive a post 50 from one or more accessories or other devices. The post 50 can extend downwardly from the one or more accessories, for example the elevated storage accessories of FIGS. 6 and 8 or the electronic device accessories of FIG. 25 (discussed further below). The openings 46 can be shaped to receive a post 50, and can be shaped to allow rotation of the post 50 within the opening 46.

The recesses 38, 40 additionally include a vertical retention slot 48 to receive a retention clip 72, 84 therein. The retention clip 72, 84 is optionally joined to a privacy panel 70 as discussed below in connection with FIG. 7, and further optionally joined to a side basket 80 as discussed below in connection with FIGS. 10-11. Each retention slot 48 is adjacent to an opening 46, and can have a width generally equal to the diameter of the adjacent opening 46. As shown in FIG. 2, each retention slot 48 extends vertically into the sloped sidewall 42 that is nearest to the outer periphery of the worksurface 22. As alternatively shown in FIG. 23, each retention slot 48 extends vertically into the base 44 of a recess 38, 40 without extending vertically into a sidewall 42. As shown in FIG. 2, the elongated recess 38 optionally includes multiple retention slots, such that retention slots 48 extend adjacent the side edge 26 and adjacent the rearward edge 28. The retention slots 48 are generally rectangular, but can include other shapes in other embodiments as desired.

To reiterate, the worksurface 22 can include a plurality of recesses 38, 40 having openings 46 and retention slots 48 therein. The recesses are optional, however, and in other embodiments no recesses are provided. The openings 46 are shaped to receive a vertical post, and the retention slots 48 are shaped to receive a vertical retention clip 72, 84. At least one of the recesses 38, 40 can include an electrical socket 228, 230 for providing power to an electrical device. The electrical sockets 228, 230 can provide an AC voltage in some embodiments, while in other embodiments the electrical socket 56 can provide a DC voltage. As also shown in FIG. 2, a recess 38, 40 can include a cord manager 56 for retaining a cable end for easy user access, while being adjacent to a vertical retention slot 48. The cord manager 56 is accessible from the top of the worksurface 22, and can be positioned elsewhere in the worksurface 22, including for example the rear recess 38.

Figure 3:
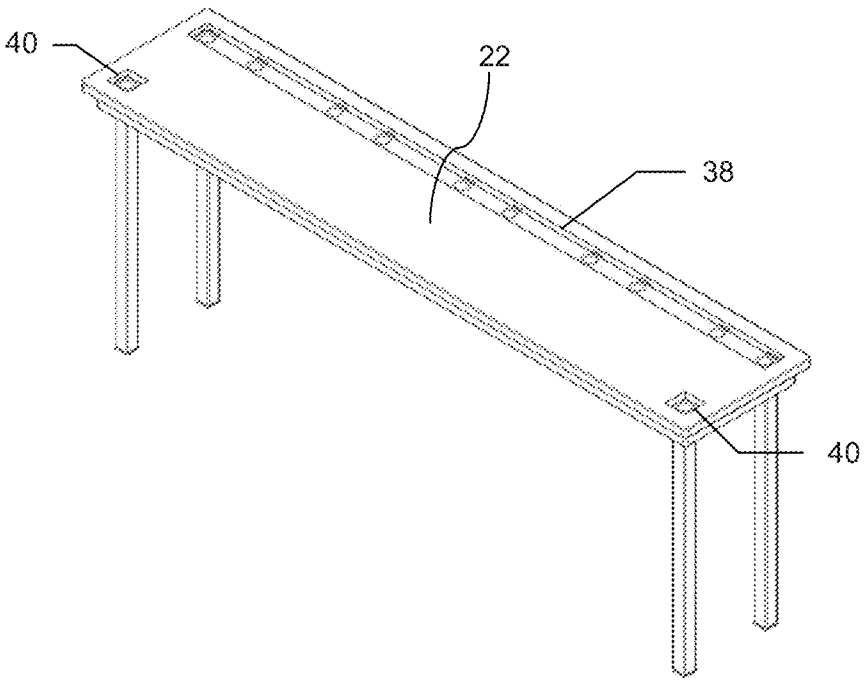
FIG. 3 is a perspective view of a side table worksurface in accordance with another embodiment of the present invention.
Figure 4:
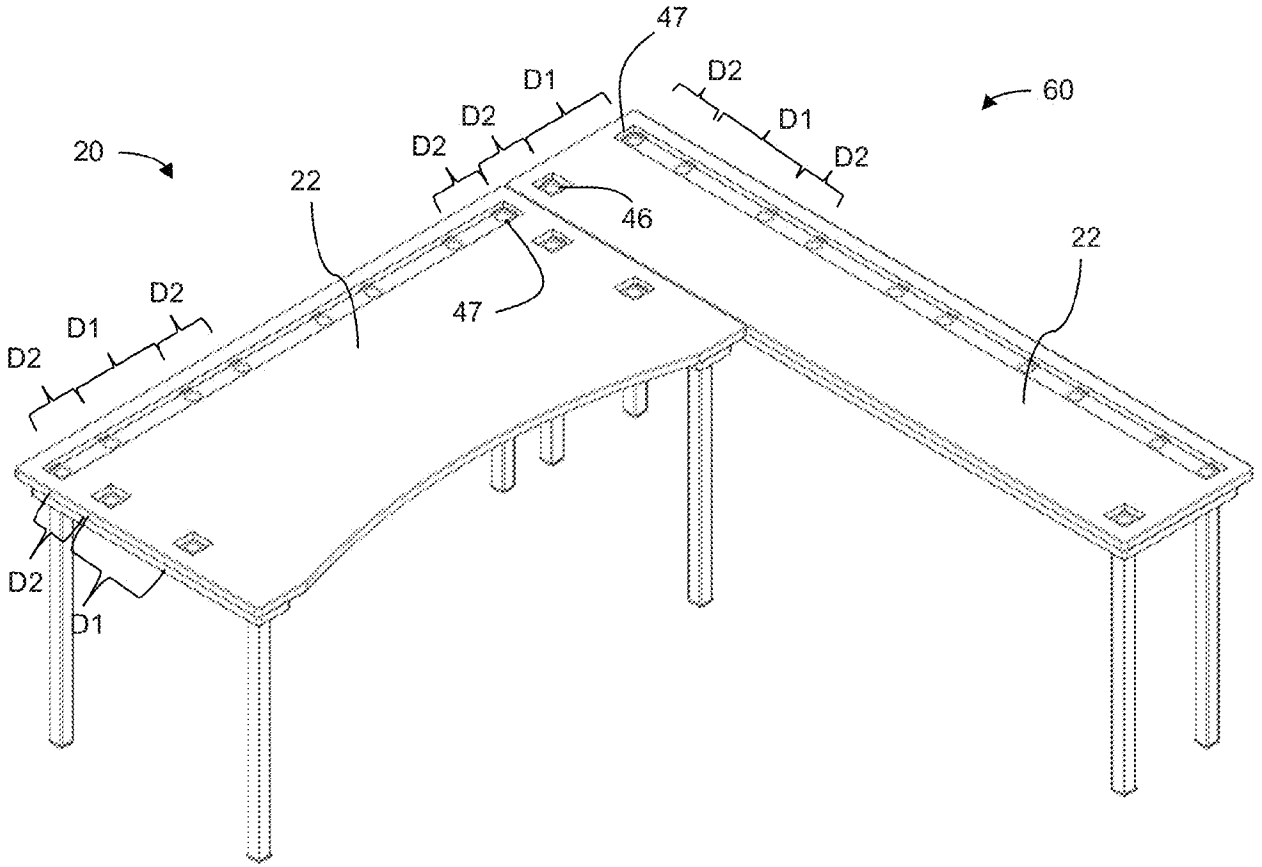
FIG. 4 is a perspective view of a worksurface system including the worksurfaces of FIGS. 1 and 3.

The worksurface 22 is shown as part of a desk 20 in FIGS. 1 and 2, but can form part of other furniture units. For example, the worksurface 22 is part of a side table 60 in FIG. 3. The desk 20 and the side table 60 are positionable at a plurality of orientations with respect to each other, thereby providing a plurality of workspace configurations. As shown in FIG. 4 for example, the desk 20 and the side table 60 are positionable adjacent each other as part of a single workspace. Though not shown, the desk 20 and the side table 60 can also be positioned in an end-to-end relationship and a back-to-back relationship. Additional desks 20 and side tables 60 can also be added to the workspace to increase the area available to the user and for multi-user configurations.

As also shown in FIG. 4, the openings 46 are disposed along the rearward portion of the worksurface 22 and along the side portions of the worksurface 22. The openings 46 are spaced apart from each other by a major distance D1 or a minor distance D2. These spacings alternate in a repeating pattern on the worksurface 22, such that each opening 46 is closer to one adjacent opening 46 than the other adjacent opening 46. In like manner, the retention slots 48 are disposed along the rearward portion of the worksurface 22 and along the side portions of the worksurface 22, each in a repeating pattern on the worksurface 22. The retention slots 48 are spaced apart from each other by the major distance D1 or the minor distance D2. These spacings alternate, such that each retention slot 48 is closer to one adjacent retention slot 48 than the other adjacent retention slot 48. The openings 46 and the retention slots 48 therefore form a repeating pattern along the rearward portion of the worksurface 22. The spacing of D1 or D2 carries over from the desk 20 to an adjacent side table 60 as shown in FIG. 4. The corner opening 47 in the desk 20 is spaced apart from the closest opening 46 in the side table 60 by D2, and is spaced apart from the closest corner opening 47 in the side table 60 by D1 plus D2. The spacing of D1 or D2 can carry over from one desk 20 to another desk 20, or from one side table 60 to another side table 60. This spacing also accommodates panels and accessories over multiple workpieces, including for example the privacy panel 70 shown in FIG. 14 discussed below. That is, panels and accessories can span two or more workpieces, such that one post is inserted into an opening in one workpiece and another post is inserted into an opening in another workpiece, wherein the posts are spaced apart from each other D3, which is an integer multiples of D1 plus D2, e.g., a·D1+b·D2, where "a" and "b" are integers (0, 1, 2, 3 etc.). For example, where D1 is 10" and D2 is 6", the posts can be spaced apart by 6", 16", or 22" and still span two worksurfaces. Further by example, FIGS. 34-45 illustrates an elevated storage stand 66 having first and second posts 50 separated by a distance D3, being equal to 1·D1+2·D2, or 22" in the illustrated embodiment. The storage stand 66 spans two workpieces in FIG. 34, and is supported by a singled workpiece in FIG. 35. Other spacings are possible in other embodiments.

Figure 5:
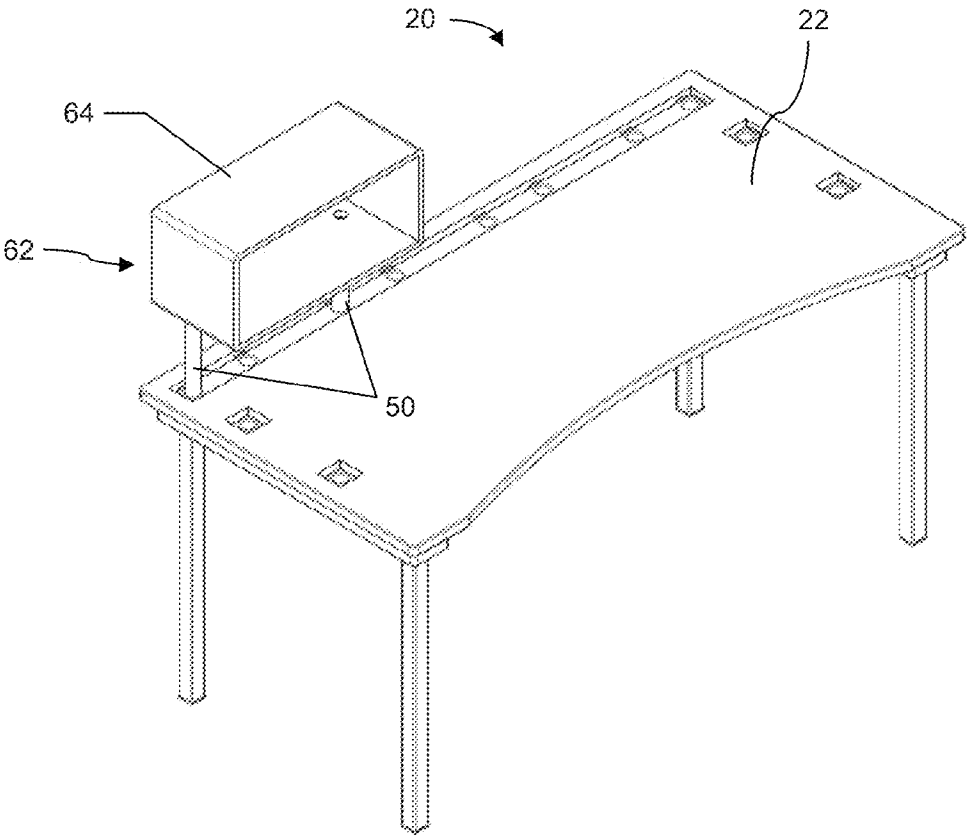
FIG. 5 is a perspective view of the desktop worksurface of FIG. 1 including an elevated shelving unit.
Figure 6:
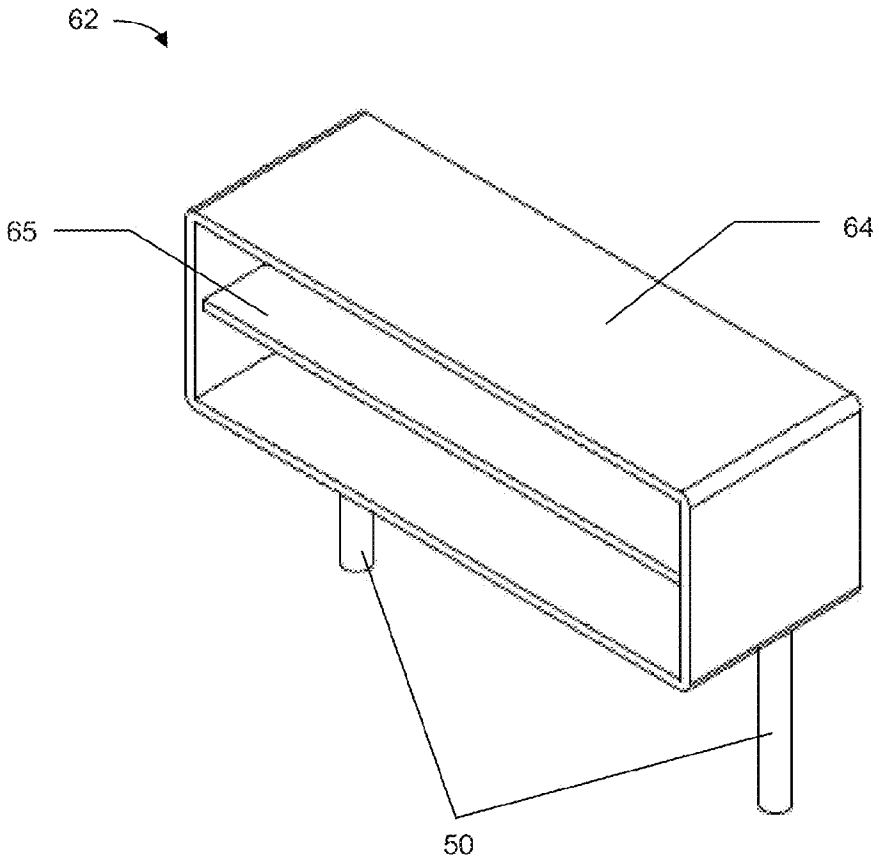
FIG. 6 is a close-up perspective view of the elevated shelving unit illustrated in FIG. 5.
Figure 7:
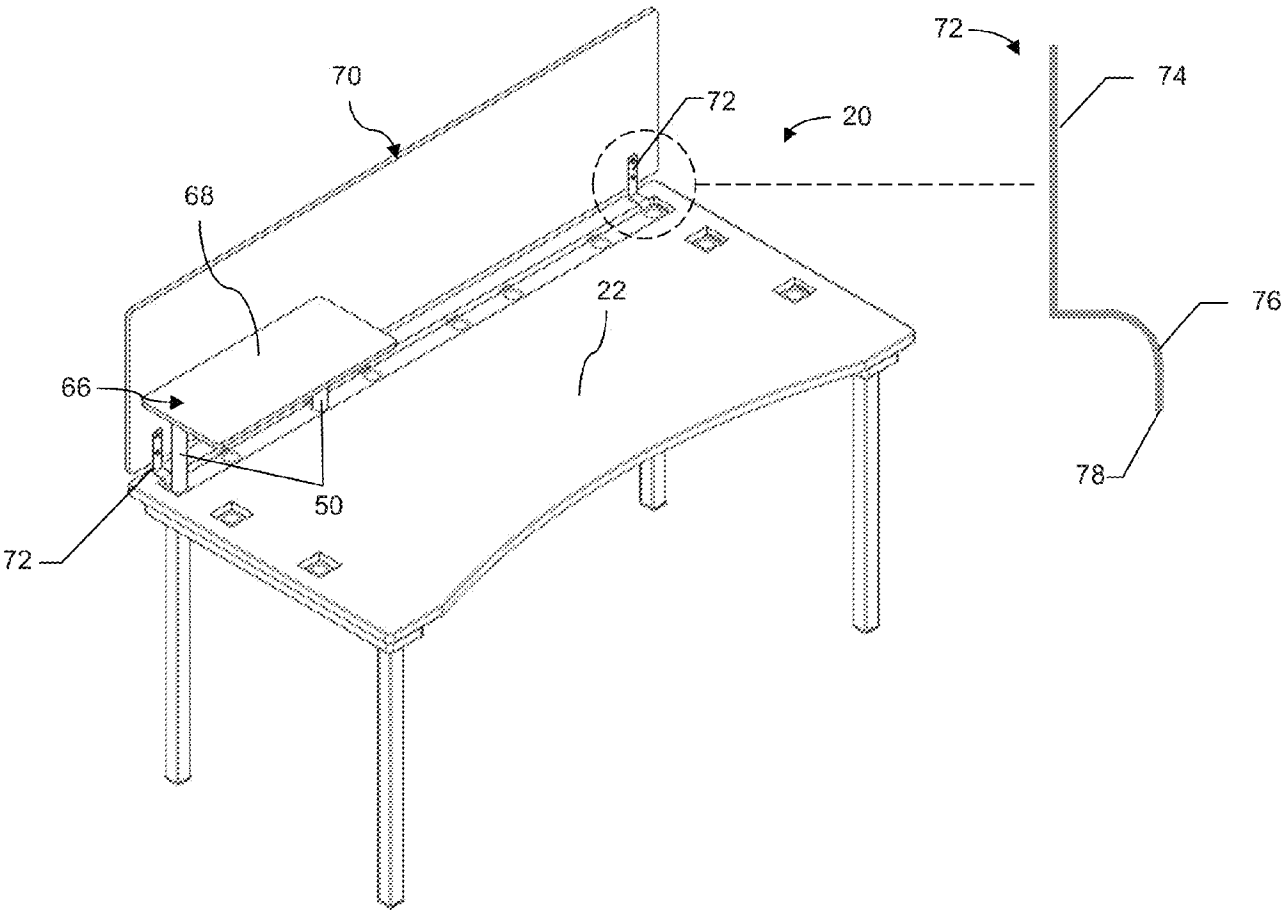
FIG. 7 is a perspective view of the desktop worksurface of FIG. 1 including an elevated support stand and a privacy panel.
Figure 8:
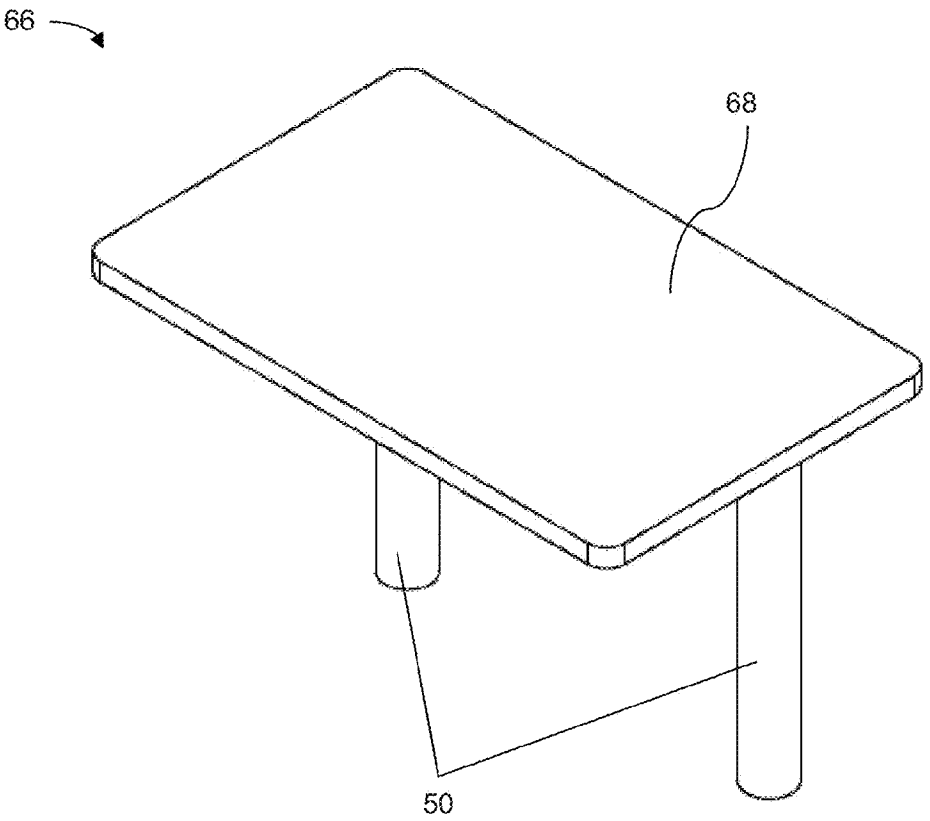
FIG. 8 is a close-up perspective view of the elevated support stand illustrated in FIG. 7.

The furniture units 20, 60 provide for the arrangement of various accessories above the worksurface 22. As shown in FIGS. 5 and 6, an elevated shelving unit 62 includes first and second downward extending posts 50 that interfit within respective first and second openings 46 in the elongated rear recess 38. The shelving unit 62 generally includes a boxlike structure or cavity 64 supported above the worksurface 22. The shelving unit 62 optionally includes a horizontal shelve 65 supported therein. The shelving unit 62 is repositionable at multiple locations, including locations along the side of the worksurface 22 and along the rear of the worksurface 22, optionally without the use of tooling. As shown in FIGS. 7 and 8, an elevated support stand 66 includes first and second downward extending posts 50 that interfit within respective first and second openings 46 in the elongated recess 38. The support stand 66 includes a support surface 68 that is supported above the worksurface. Like the shelving unit 62, the support stand 66 is repositionable at multiple locations, including locations along the side of the worksurface 22 and along the rear of the worksurface 22, and across multiple workpieces where one post 50 interfits with a first workpiece and a second post 50 interfits with a second workpiece.

Figure 9:
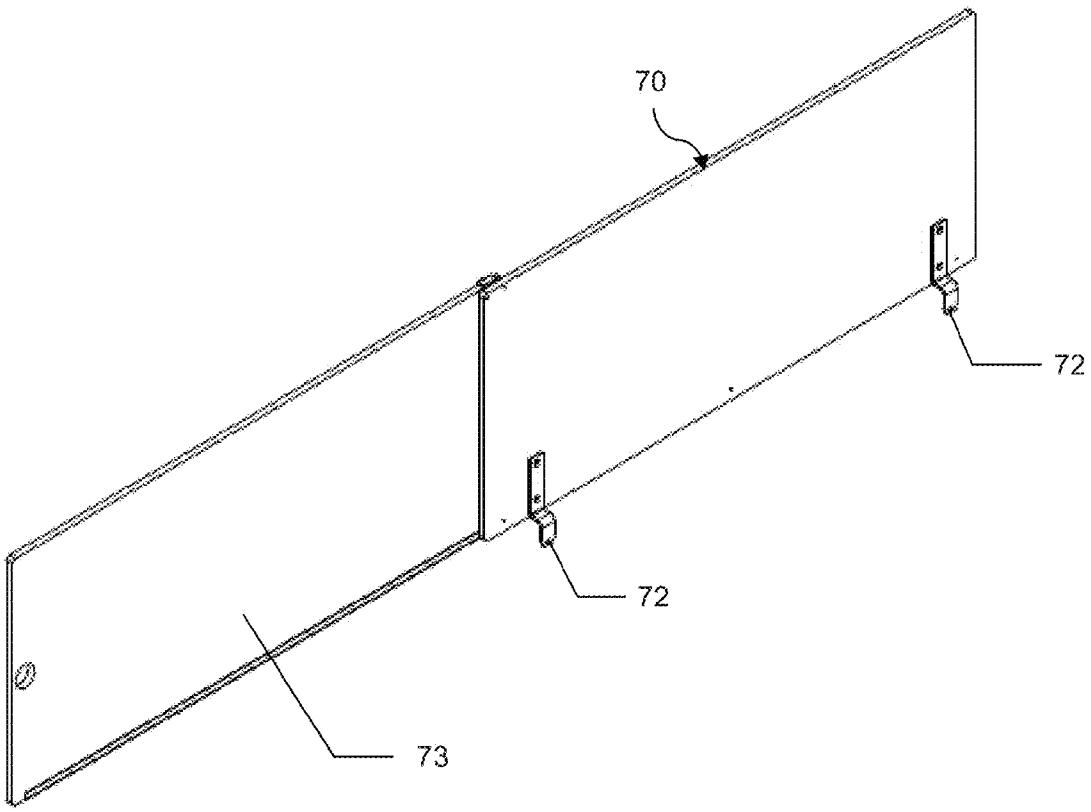
FIG. 9 is a close-up perspective view of the privacy panel illustrated in FIG. 7 further including an extension panel.

The furniture units 20, 60 provide for the attachment of additional accessories to the worksurface. As shown in FIG. 7, a privacy panel 70 is joined to first and second retention clips 72 that interfit within respective first and second retention slots 48 in the elongated recess 38. The retention clips 72 are spaced apart by a distance equal to the distance separating two of the retention slots 48. The privacy panel 70 is coextensive in length with the desk worksurface 22 in the illustrated embodiment, optionally including a sliding extension 73 as shown in FIG. 9. In addition, the privacy panel 70 is offset rearwardly with respect to the retention slots 48, such that the privacy panel 70 does not overlie the retention slots 48 or the openings 46. The privacy panel 70 is positioned above the worksurface 22, however, being generally flush with the rearward edge 28 of the worksurface 22. In this respect, worksurfaces 22 and privacy panels 70 can be arranged in back-to-back configurations with substantially no gap therebetween. As shown in FIG. 7, the elevated support stand 66 is also supported within the elongated recess 38. Additional accessories can be added where desired, including for example the shelving unit 62 of FIG. 6 above.

The retention clip 72 in accordance with one embodiment is shown in FIG. 7. The retention clip 72 includes an upper segment 74 and a lower segment 76. The upper segment 74 is configured for attachment to the privacy panel 70, and the lower segment 76 is configured for insertion into a retention slot 48. The upper segment 74 is planar in the illustrated embodiment, defining first and second through-holes for receipt of respective first and second fasteners therein. The lower segment 76 is curved in the illustrated embodiment, terminating in a vertical free end 78 that is inserted into a vertical retention slot.

Figure 10:
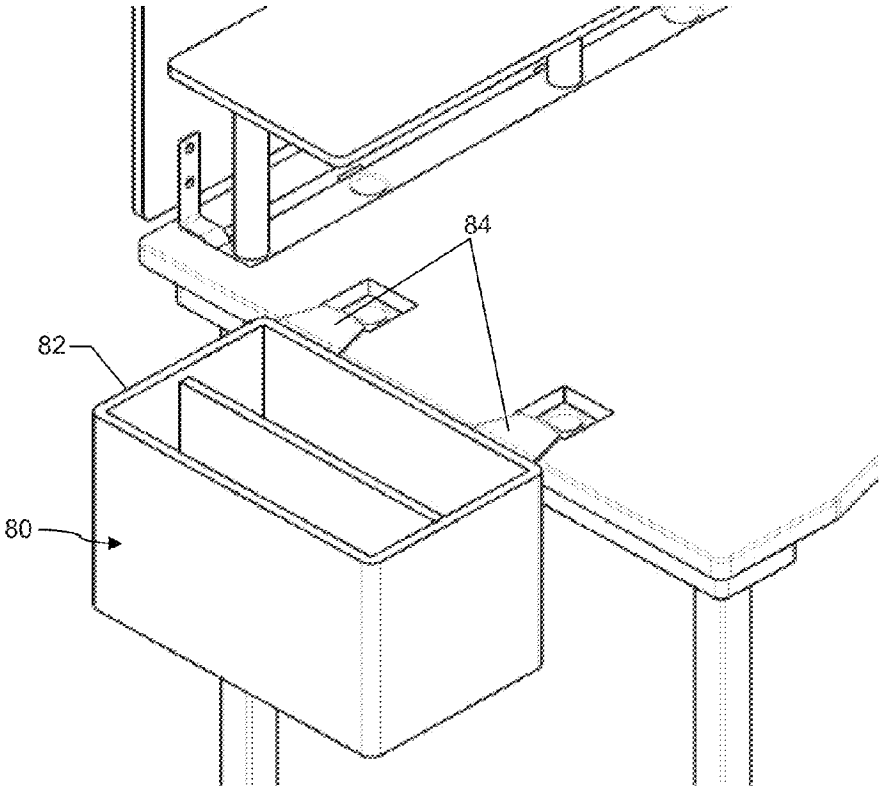
FIG. 10 is a close-up view of the desktop worksurface of FIG. 1 including a side basket.
Figure 11:
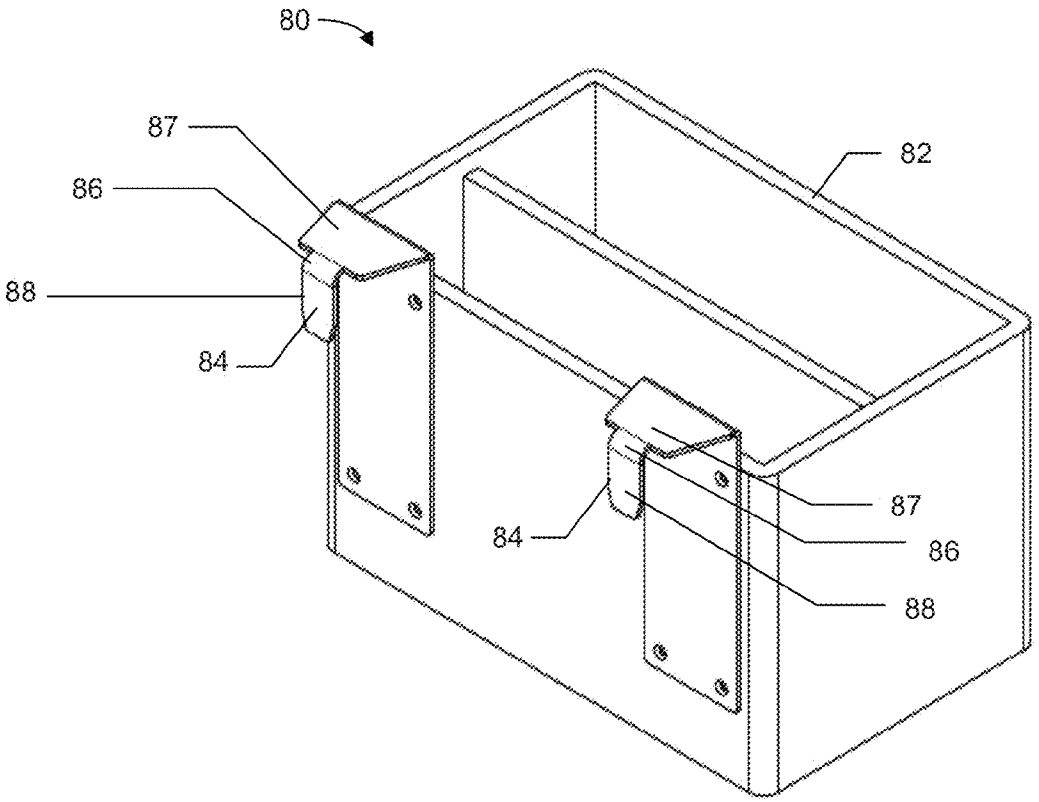
FIG. 11 is a close-up perspective view of the side basket illustrated in FIG. 10.

A side basket is illustrated in FIGS. 10 and 11 and generally designated 80. The side basket 80 includes an enclosure 82 and first and second retention clips 84. The retention clips 84 are spaced apart by a distance equal to the distance separating two retention slots 48. The retention clips 84 include an L-shaped segment 87 for attachment to the enclosure 82, a planar segment 88 for insertion into a retention slot 48, and a curved segment 86 therebetween. The retention clips can be formed of any suitable material, including for example steel or aluminum metal.

While described above as receiving separate elements, the vertical opening 46 and the retention slot 48 can optionally receive a post that is joined to a retention clip, thereby preventing rotation of the post within the opening 46. In particular, a retention clip can be rigidly joined to a post for dual insertion into a vertical opening 46 and retention slot 48 within a worksurface 22. This construction can also ensure the accessory is forward facing. That is, a combined post and retention clip can be inserted in only a single direction, preventing the installation of a rearward facing support shelf 62, for example. Alternatively, the vertical opening 46 can be keyed with a notch or a groove, such that a post having a corresponding notch or groove can fit into the vertical opening 46 without relative rotation therebetween. In some embodiments, the post can be maintained at a designated orientation (e.g., 0°, 90°, 180°, 270°) within the vertical opening 46. In still other embodiments, the post is locked with respect to the vertical opening 46, thereby preventing the removal of the accessory from the workstation, optionally through the use of a bayonet connection having a locking feature.

Figure 12:
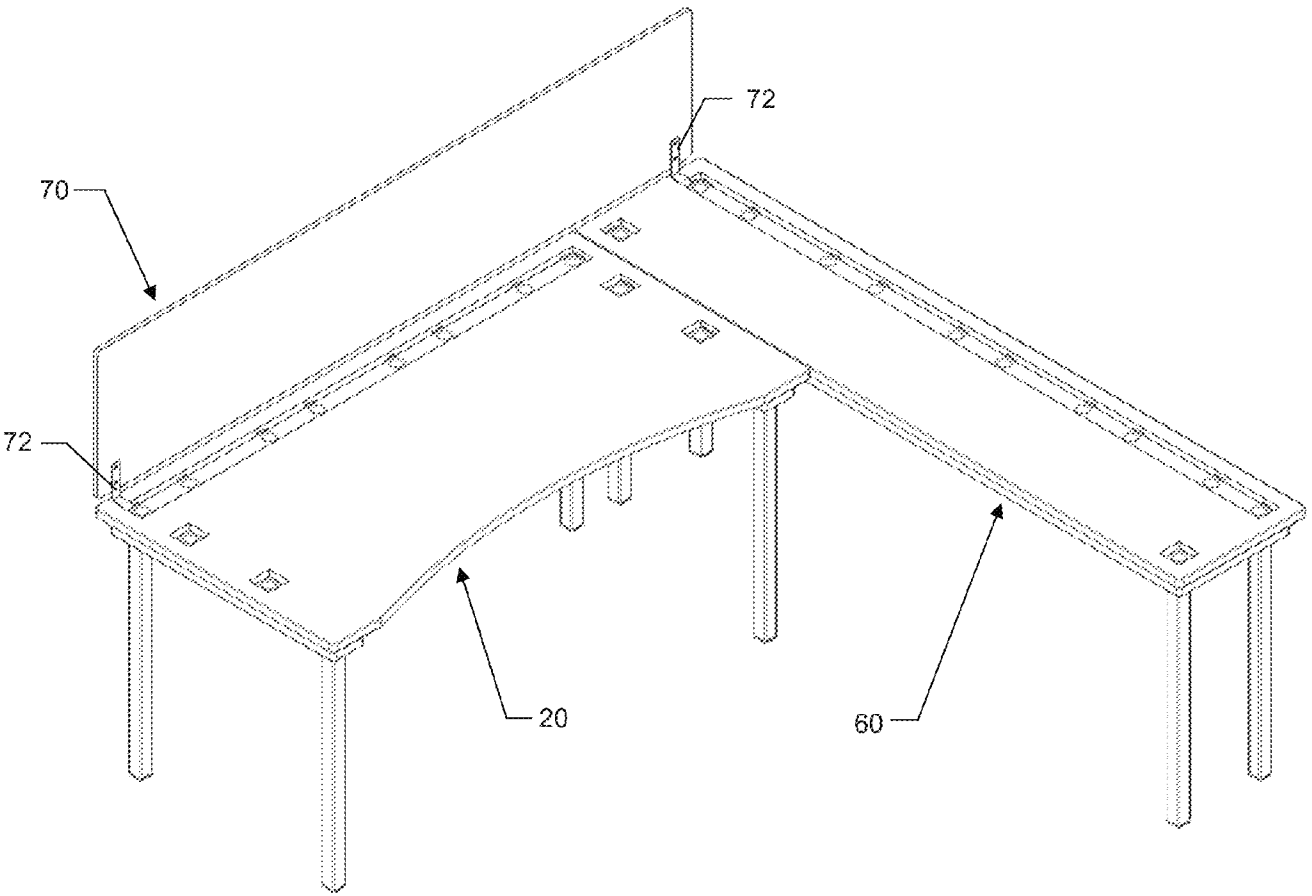
FIG. 12 is a perspective view of the worksurface system of FIG. 4 including a privacy panel spanning a desktop worksurface to a side table.
Figure 13:
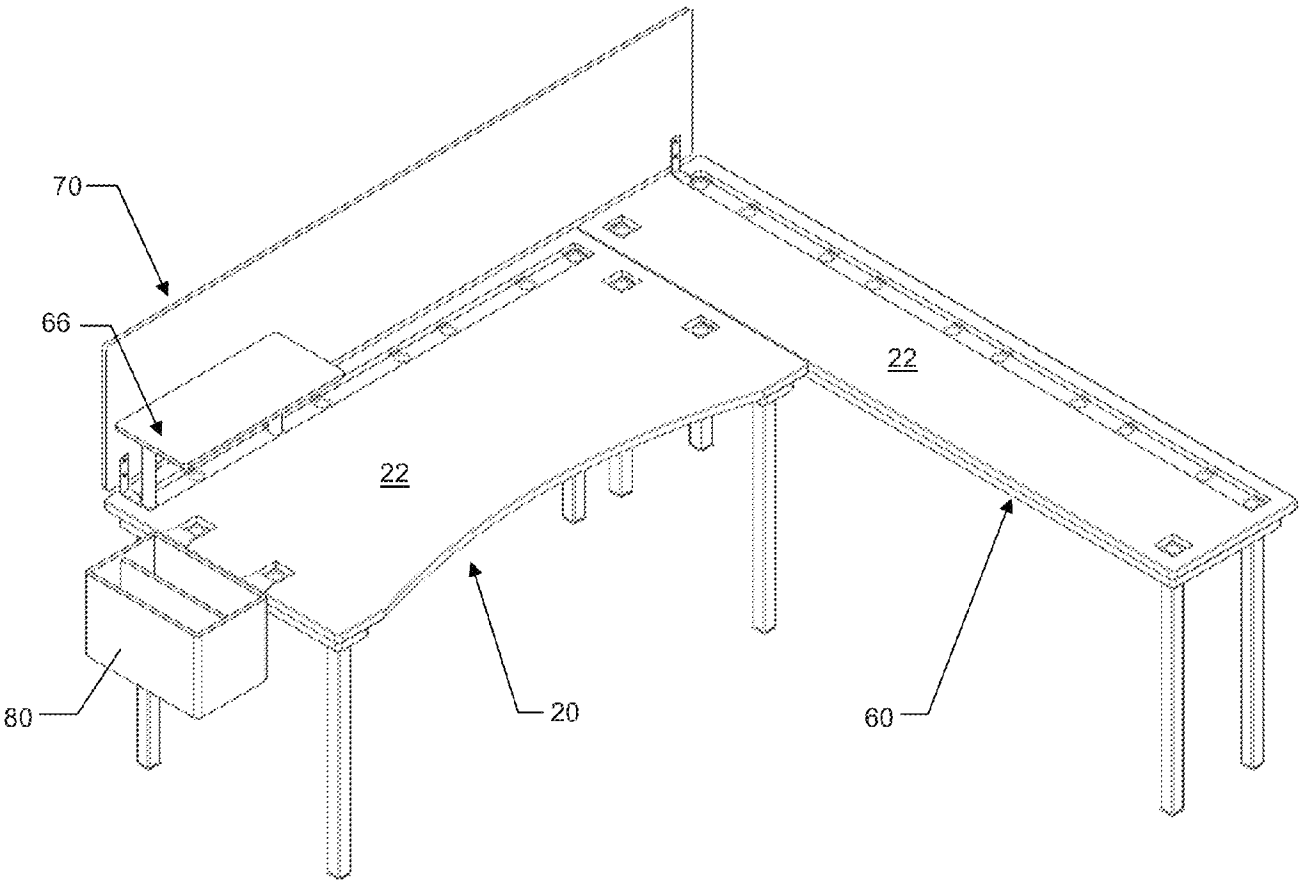
FIG. 13 is a perspective view of the worksurface system of FIG. 12 including an elevated support stand and a side basket.
Figure 14:
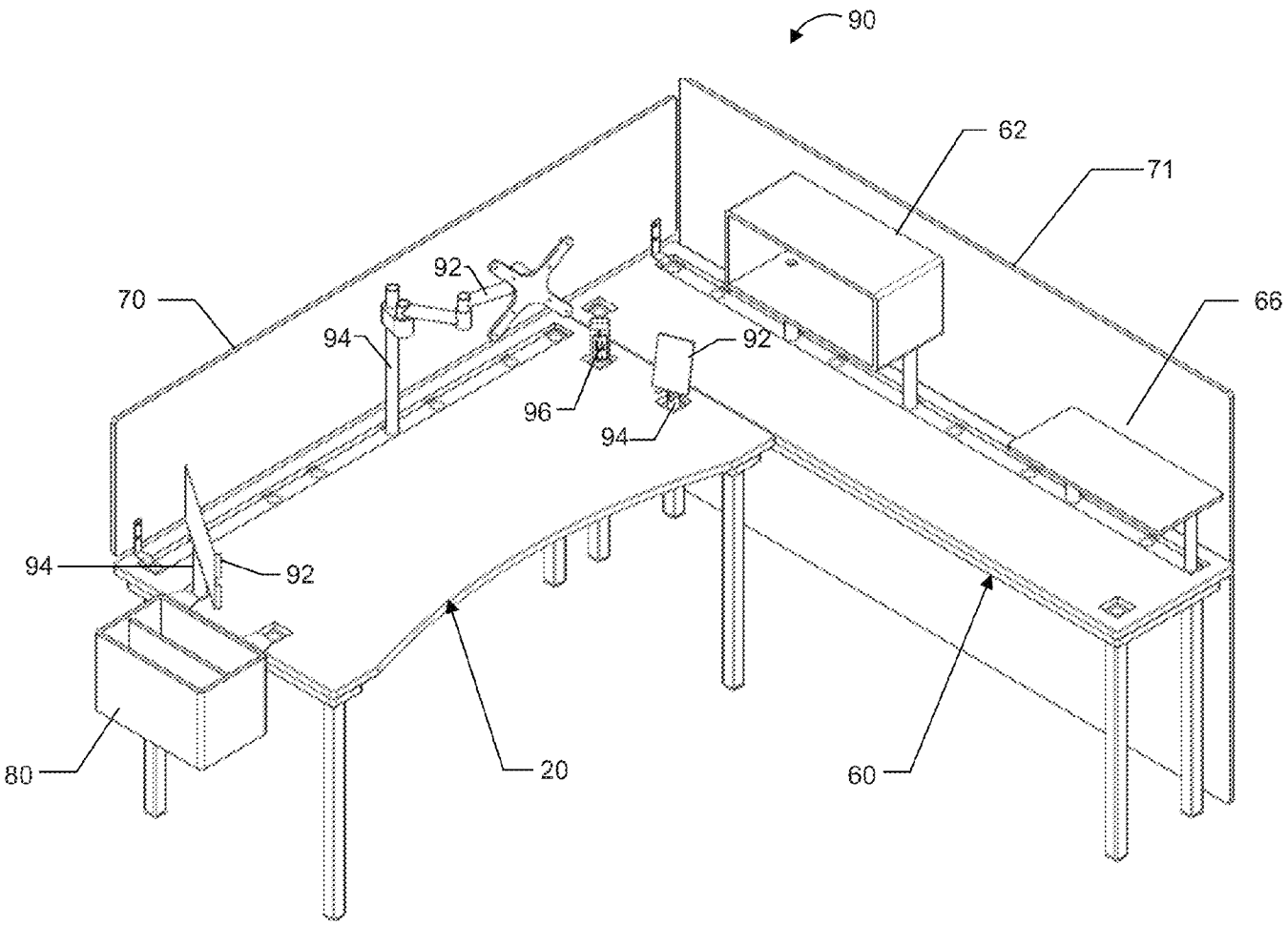
FIG. 14 is a perspective view of the worksurface system of FIG. 13 including a shelving unit, modular docking cradles, an electrical socket, and a full height privacy panel.

FIGS. 12-14 illustrate a worksurface system 90 including various accessories. As shown in FIG. 12, the worksurface system 90 includes a desk 20, a side table 60, and a privacy panel 70. The privacy panel 70 is joined to first and second retention clips 72, with the first retention clip 72 being inserted into a retention slot in the desk 20, and the second retention clip 72 being inserted into a retention slot in the side table 60. The ability to span multiple worksurfaces applies to the remaining accessories as well. An additional panel 71 extends vertically behind the side table 60. As shown in FIG. 13, a support stand 66 is supported above the desk worksurface 22, and a side basket 80 is anchored to the side of the desk worksurface 22. As shown in FIG. 14, a support stand 66 is supported above the side table worksurface 22. The worksurface system 90 also includes a shelving unit 62 and docking cradles 92 within available openings 46. The docking cradles 92 are adapted to support a smartphone, a tablet, or a flat panel display, and include a downward extending post or stanchion 94. An optional electrical socket 96 extends vertically through one opening 46 to provide power to these or other electronic devices.

Figure 15:
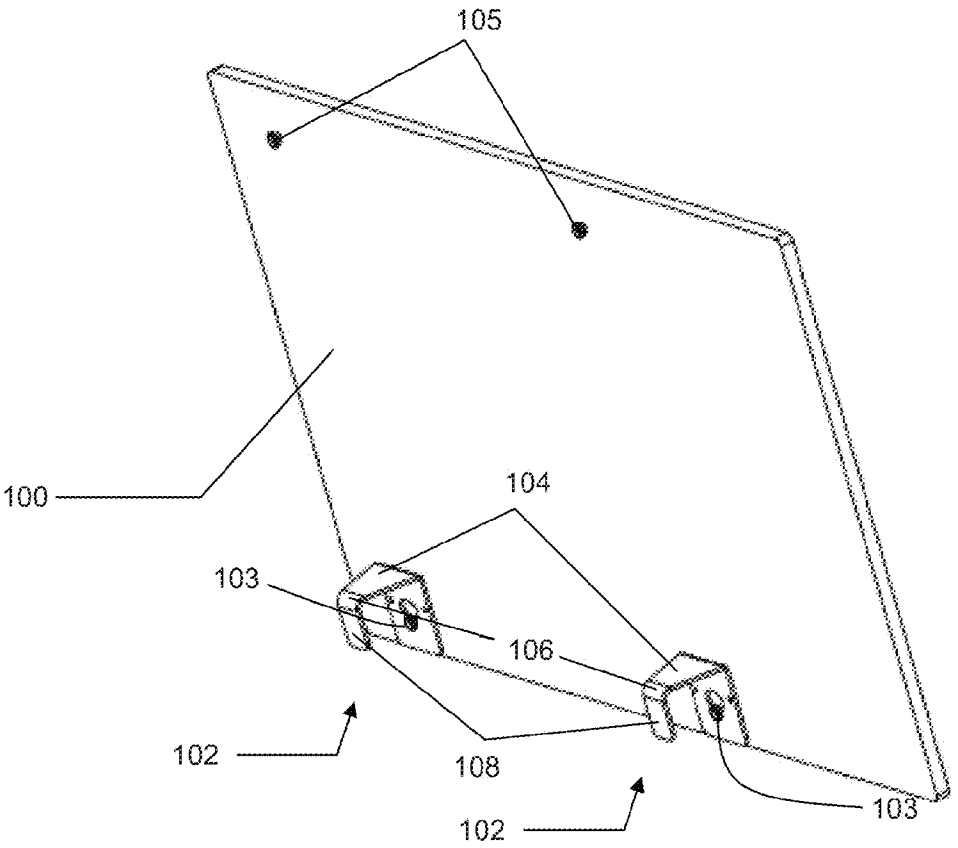
FIG. 15 is a perspective view of a side privacy panel having a selectable height for use for use as a side modesty panel with the worksurface system of FIG. 1.

Additional accessories are illustrated in FIGS. 15 through 18. For example, a side privacy panel is illustrated in FIG. 15 and designated 100. The side privacy panel 100 is similar in structure and function to the privacy panel 70 noted above, and includes a width approximately equal to the depth of the worksurface 20 or the side table 60. In addition, the side privacy panel 100 includes adjacent retention clips 102 that interfit within respective retention slots 48. The retention clips 102 are spaced apart by a distance equal to the distance separating two retention slots 48. The retention clips 102 include a horizontal segment 104, a downwardly curved segment 106, and a vertical segment 108. The side privacy panel 100 includes lower and upper pins 103, 105 that are shaped to extend through keyholes in the retention clips 102. The retention clips 102 can be moved from the lower pins 103 to the upper pins 105 to convert the side privacy panel 100 into a side modesty panel 100. The side privacy panel 100 is offset with respect to the openings 46, such that the side privacy panel 100 does not overlie the openings 46. Additional storage accessories can be added to the openings where desired, including for example the shelving unit 62 and the support stand 66 of FIG. 14 above.

Figure 16:
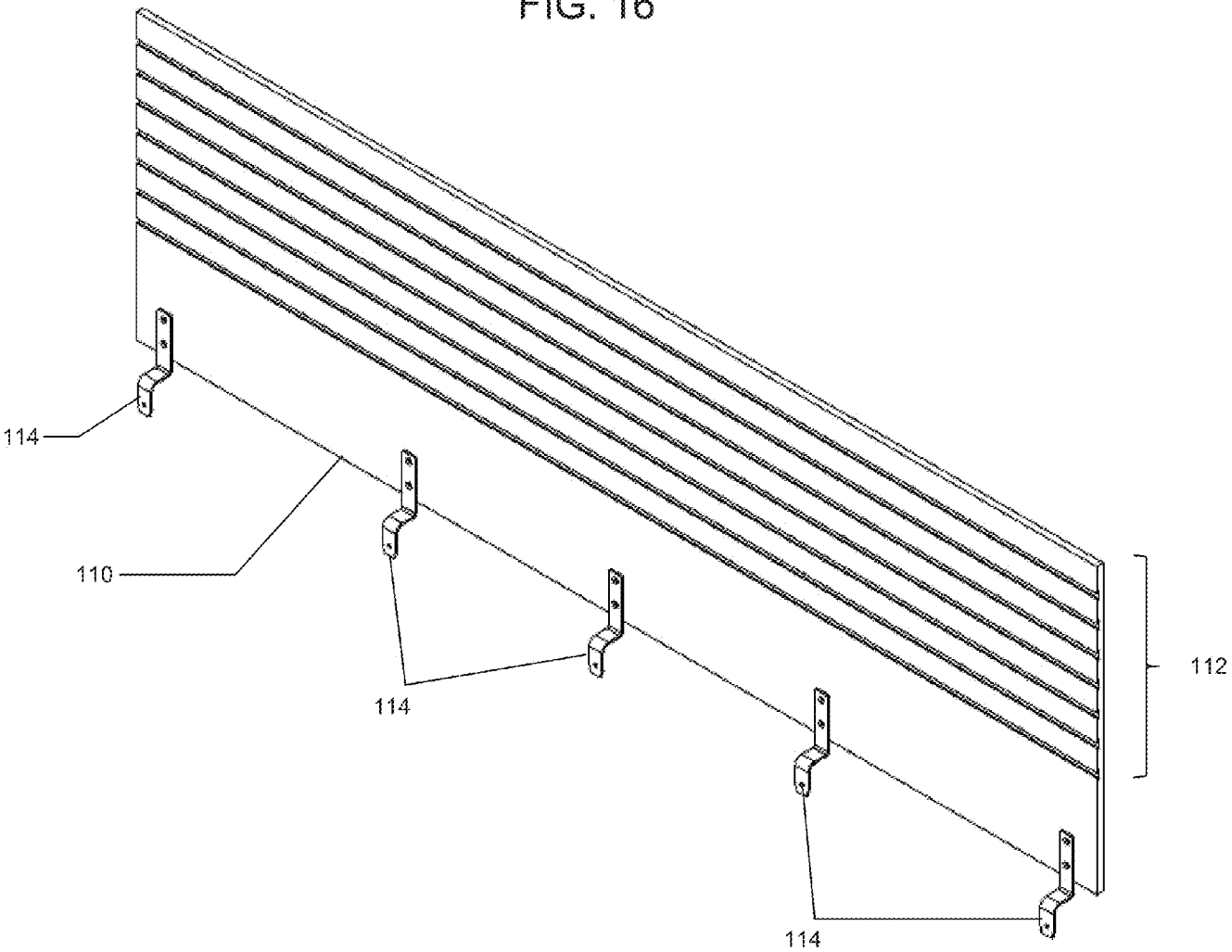
FIG. 16 is a perspective view of a slatted privacy panel for use with the worksurface system of FIG. 1.
Figure 18:
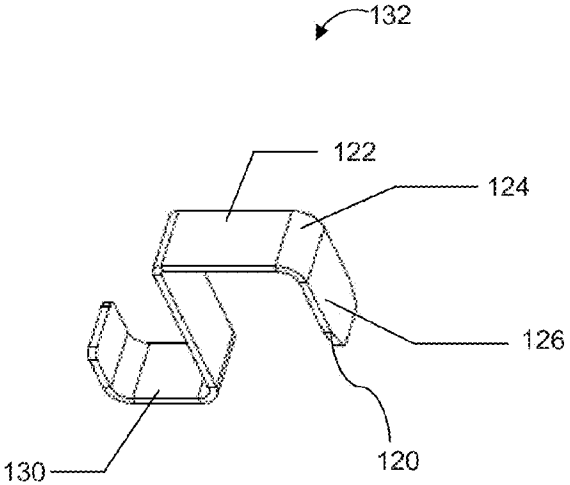
FIG. 18 is a perspective view of a bag hook for use with the worksurface system of FIG. 1.
Figure 17:
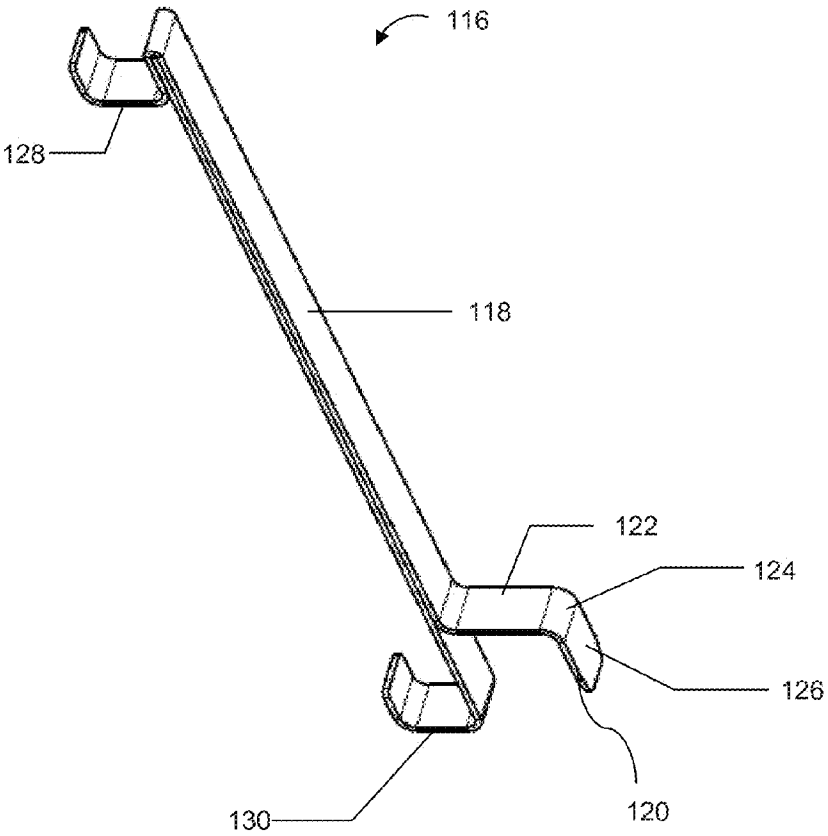
FIG. 17 is a perspective view of a bag and coat hook for use with the worksurface system of FIG. 1.
Figure 19:
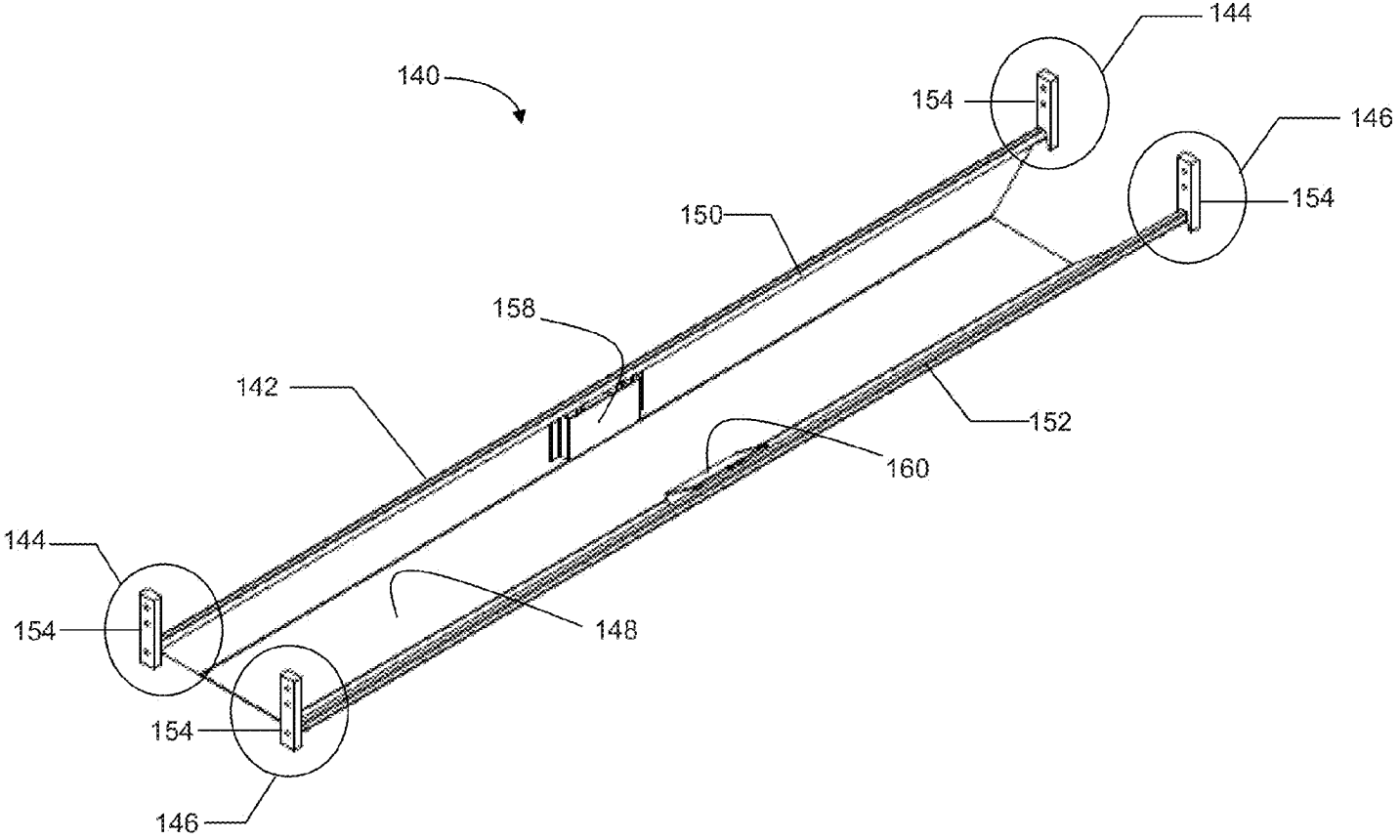
FIG. 19 is a perspective view of a desk wire tray for use with the worksurface system of FIG. 1.

A further privacy panel is illustrated in FIG. 16 and generally designated 110. The privacy panel 110 is similar in function and structure to the privacy panel 70 noted above, and includes horizontal slats 112 and a plurality of retention clips 114. The privacy panel 110 includes a length approximately equal to the length of the desk 20 or the side table 60 in the current embodiment, but can be longer if spanning two workpieces in other embodiments. In addition, adjacent retention clips 114 are spaced apart by a distance equal to the distance separating two retention slots 48. A coat hook and a bag hook are further optionally illustrated in FIGS. 17 and 18, respectively. The coat hook is generally designated 116, and includes a vertical member 118 extending generally perpendicular to the worksurface 22. The coat hook 116 includes a retention clip 120, including a horizontal segment 122, a curved transition segment 124, and a vertical segment 126. The coat hook 116 additionally includes a J-shaped hook portion 128 at the upper extent of the vertical member 118 and a J-shaped hook portion 130 at the lower extent of the vertical member 118. The bag hook is illustrated in FIG. 18 and generally designated 132. The bag hook 132 is similar in structure and function to the coat hook 116 of FIG. 17, except that the bag hook 132 does not include a J-shaped hook portion at the upper extent of a vertical member.

Figure 20:
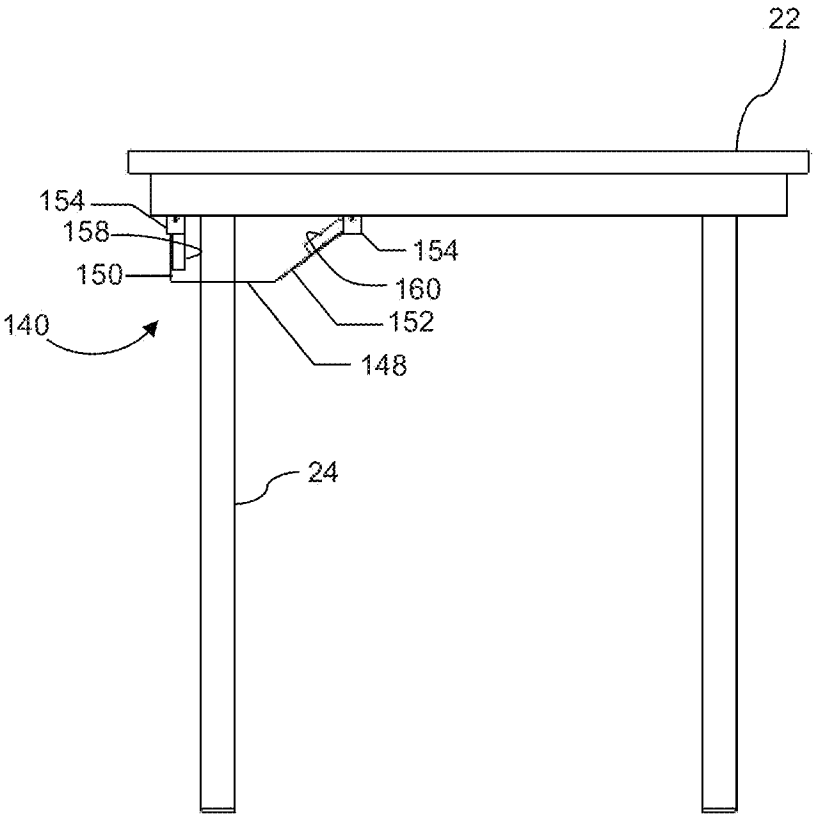
FIG. 20 is a side view of the desk wire tray of FIG. 19 joined to a worksurface along first and second hinged connections.
Figure 21:
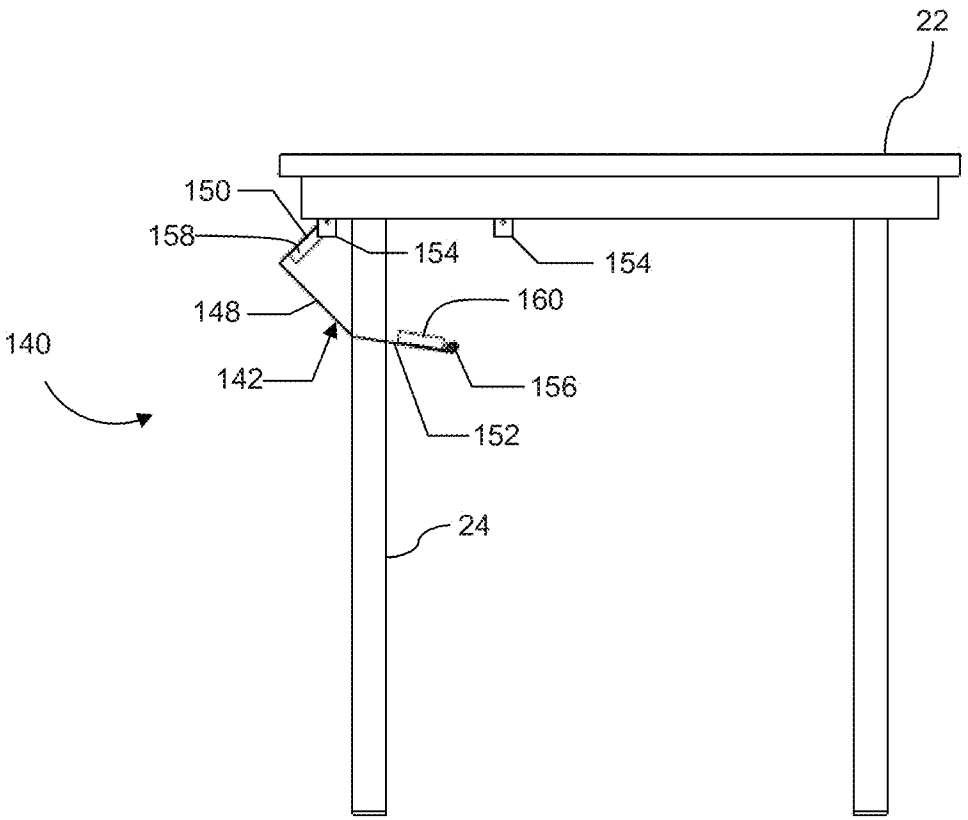
FIG. 21 is a side view of the desk wire tray of FIG. 19 joined to a worksurface along the first hinged connection.
Figure 22:
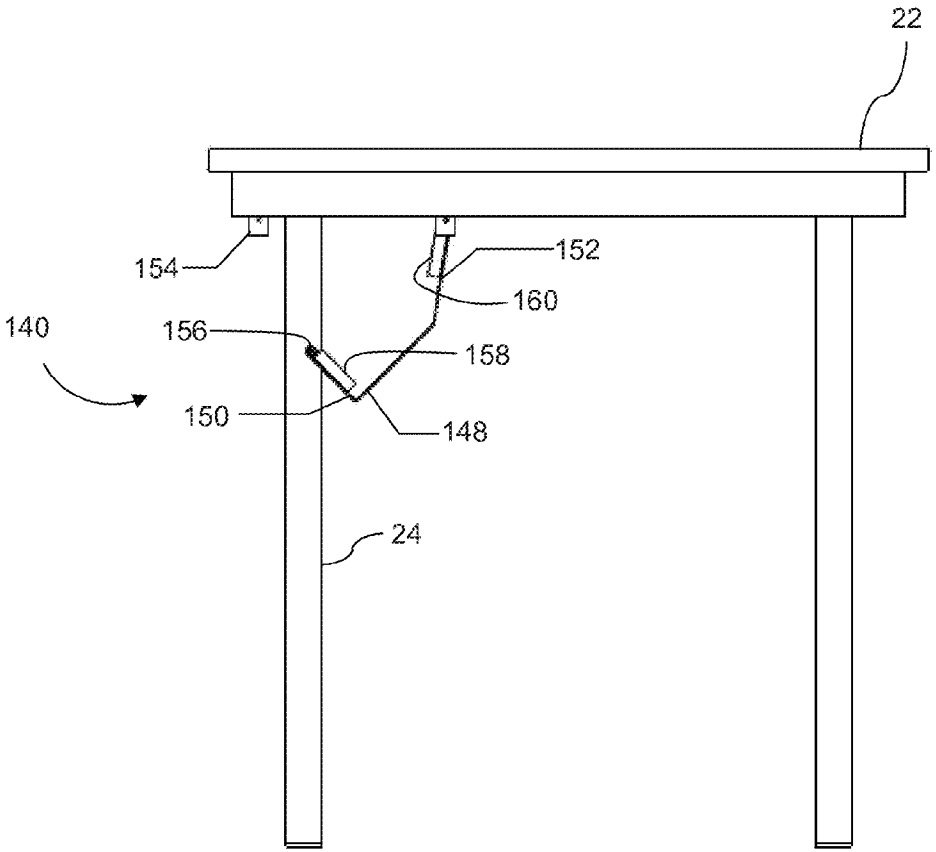
FIG. 22 is a side view of the desk wire tray of FIG. 19 joined to a worksurface along the second hinged connection.

In a further embodiment, a desk wire tray is provided. The desk wire tray is illustrated in FIGS. 19-22 and generally designated 140. As set forth below, the desk wire tray 140 is selectively positioned beneath the worksurface 22 to function as a wire raceway, including for example power cords, phone lines, data cables, and other electronic devices and power supplies. As more particularly shown in FIG. 19, the desk wire tray 140 includes a wire management channel 142 and first and second hinged connections 144, 146. The wire management channel 142 is generally coextensive in length with the worksurface 22 in the present embodiment, but can be slightly or substantially shorter than the length of the worksurface 22 in other embodiments. The wire management channel 142 is shaped to receive and consolidate a plurality of wires therein. As shown in FIG. 20, the wire management channel 142 includes a generally U-shaped cross-section, including a bottom panel 148 and first and second side panels 150, 152. The first side panel 150 is generally vertical and the bottom panel 148 is generally horizontal when the wire management channel 142 is secured at both hinged connections 144, 146 to the worksurface 22, as generally shown in FIG. 20. The first and second side panels 150, 152 are generally trapezoidal in the present embodiment, such that the bottom panel 148 does not interfere with the table legs 24. The wire management channel 142 is optionally free of end panels, such that two or more wire management channels can be positioned in serial arrangement under adjoining worksurfaces 22, along power cables to extend freely from one wire management channel to the next. Though not shown, the wire management channel 142 can additionally include one or more cabling apertures in the bottom panel 148 or the side panels 150, 152 to allow wiring to extend therethrough.

The first and second hinged connections 144, 146 releasably join the wire management channel 142 to the worksurface 22. In this regard, the desk wire tray 140 is modular, and can be added to and removed from the worksurface 22 as desired, optionally without the use of tools. The first and second hinged connections 144, 146 are spaced apart from each other and include fixed portions 154 connected to the underside of the worksurface 22. The first and second hinged connections 144, 146 additionally include hinged portions, for example pivot pins 156 (see FIGS. 21 and 22), received within the fixed portion 154. The pivot pins 156 secure the wire management channel 142 to the fixed portions 154 and allow the wire management channel 142 to pivot to an open position, thereby allowing front or rear access to the wire management channel 142 from beneath the worksurface 22. The desk wire tray 140 additionally includes first and second locking mechanisms 158, 160 to unlock the first and second hinged connections 144, 148, respectively. The locking mechanisms 158, 160 actuate the pivot pins 156 between a retracted position and an extended position. When the pivot pins 156 are in the retracted position, the wire management channel 142 is free to open downwardly relative to the worksurface 22. When the pivot pins 156 are in the extended position, the wire management channel 142 can be pivoted about the pivot pins 156, provided the wire management channel 142 is joined to the worksurface 22 along one of the hinged connections 144, 146. The locking mechanisms 158, 160 can include any mechanism to actuate the pivot pins 156, including for example a spring loaded latch that biases the pivot pins 156 into the extended position. Other locking mechanisms 158, 160 can be used where desired.

Figure 23:
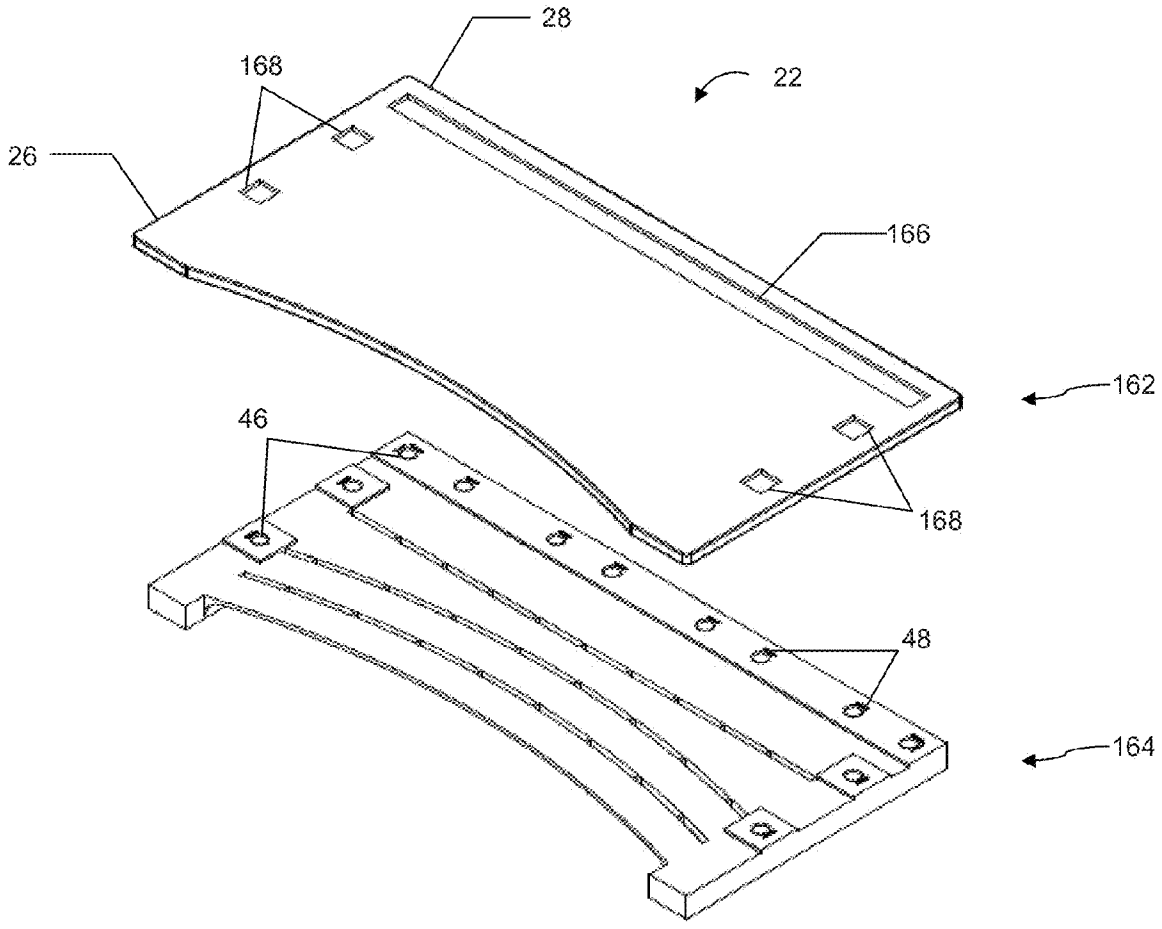
FIG. 23 is an exploded perspective view of the worksurface of FIG. 1 including an upper portion and a lower portion.
Figure 24:
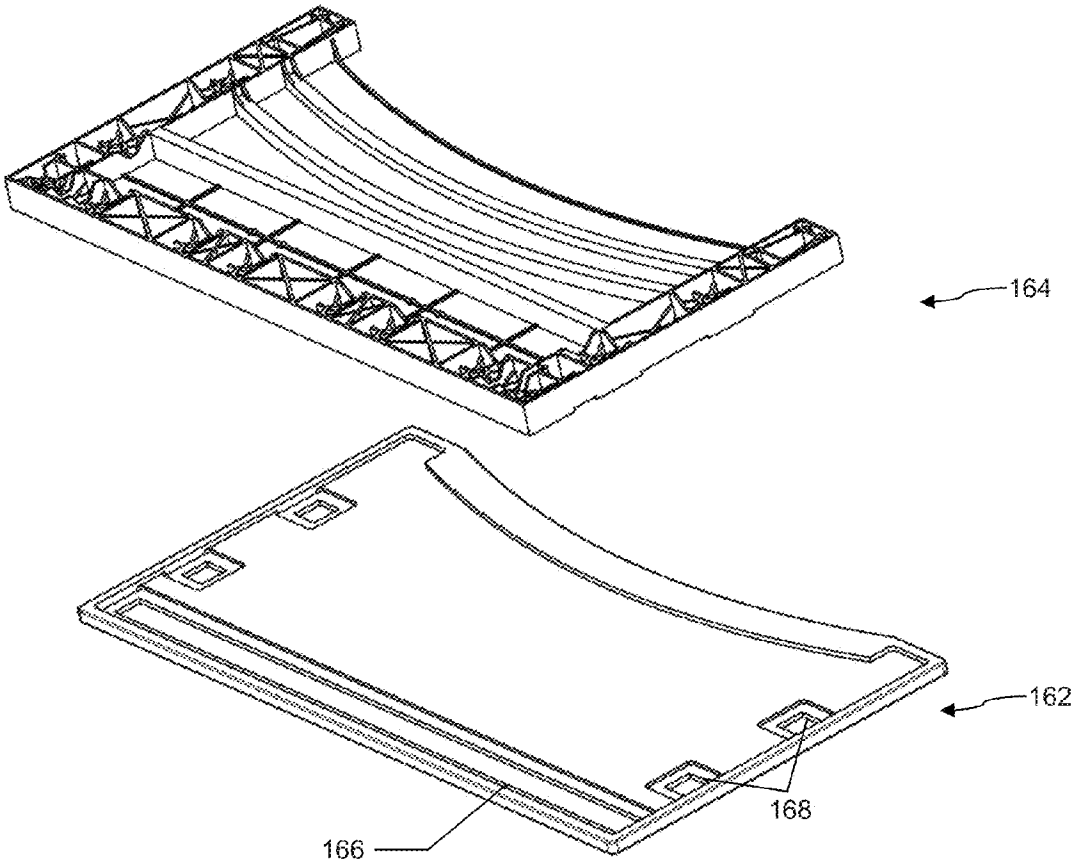
FIG. 24 is an inverted exploded perspective view of the worksurface of FIG. 1 including an upper portion and a lower portion.

As noted above, the worksurface 22 generally includes a plurality of openings 46 and a plurality of retention slots 48 disposed along at least a portion of the periphery of the worksurface 22, where the openings 46 and the retention slots 48 are adapted to support interchangeable accessories and privacy panels. The openings 46 and the retention slots 48 are optionally disposed within a recessed portion of the worksurface 22 that are adjacent a rear edge 28 or a side edge 26 of the worksurface 22. As shown in FIG. 23, for example, the worksurface 22 includes an upper portion 162 and a lower portion 164. The upper portion 162 is substantially planar, and includes an elongated aperture 166 that defines the aforementioned elongated recess 38. The upper portion 162 additionally includes multiple side apertures 168 that define the aforementioned side recesses 40. The apertures 166, 168 include a vertical sidewall in the present embodiment, but can be sloped, beveled, or curved in other embodiments. As also shown in FIG. 23, the worksurface 22 includes a lower portion 164. The lower portion 164 directly engages a lower facing surface of the upper portion 162, and defines the plurality of vertical openings 46 and the plurality of retention slots 46 therein. The underside of the upper and lower portions 162, 164 is illustrated in FIG. 24. The elongated aperture 166 and the side apertures 168 extend entirely through the upper portion 162, while the vertical openings 46 and the retention slots 48 extend into, but not entirely through, the lower portion 164. The vertical openings 46 can include a stop ridge to limit travel of a post therein and/or for orientation control. The vertical retention slots 48 may or may not extend entirely through the lower portion 164, and generally are not uniform openings in embodiments where they do extend entirely through the lower portion 164.

Figure 25:
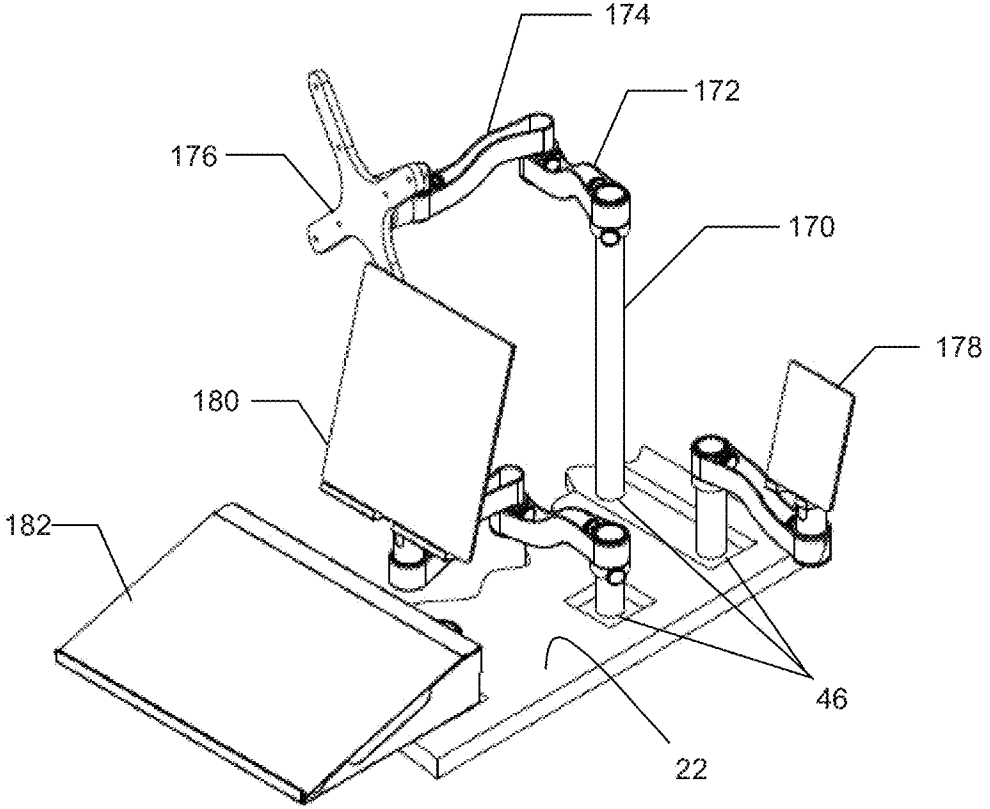
FIG. 25 is a perspective view of the worksurface of FIG. 1 including multiple electrical device support accessories.

Additional accessories are illustrated in FIG. 25, the accessories being configured to support various technology tools. The technology tool accessories can include posts 170 of varying heights, lower and upper swivel arms 172, 174, mounting brackets 176, smartphone cradles 178, tablet cradles 180, and laptop stands 182. Other technology tool accessories can be used in other embodiments where desired, including for example a paper holder and a mini whiteboard.

Figure 28:
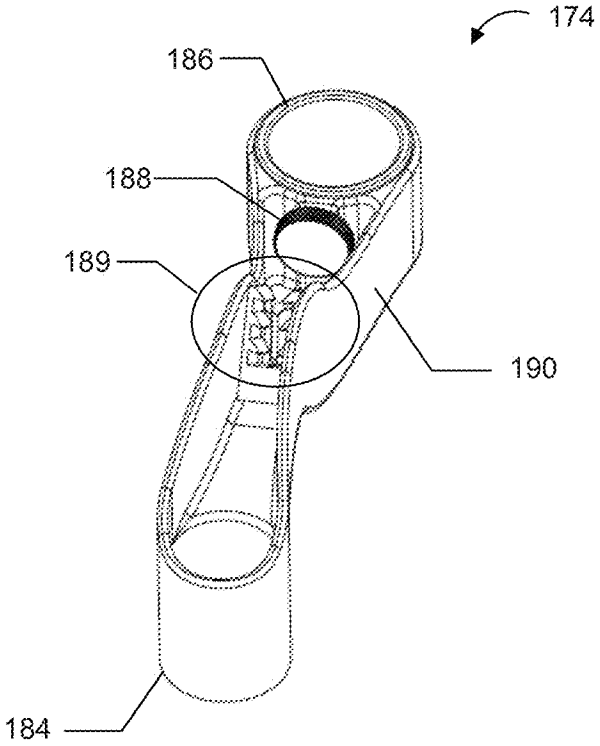
FIG. 28 is a second perspective view of the upper swivel arm of FIG. 26.
Figure 27:
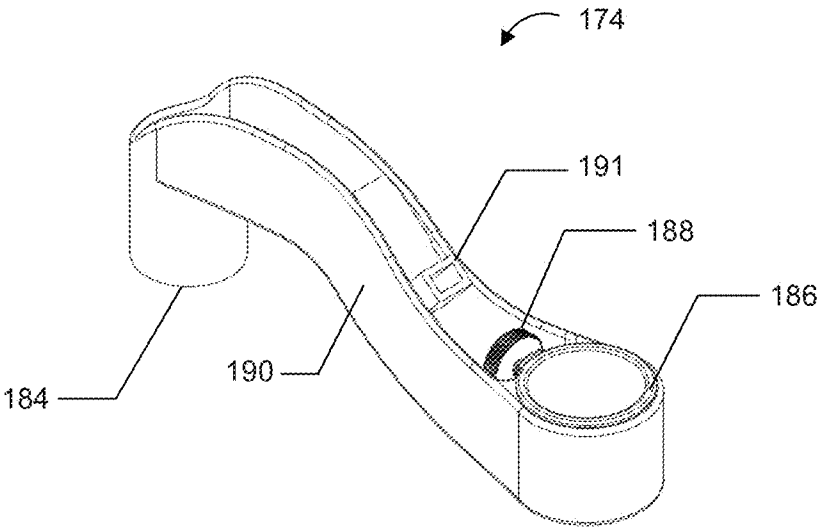
FIG. 27 is a first perspective view of the upper swivel arm of FIG. 26.

Referring to FIGS. 27-28, the upper swivel arm 174 includes a male pivoting portion 184 at one end thereof and a female pivoting portion 186 at another end thereof. In the illustrated embodiment, the male pivoting portion 184 includes a downward extending pivot post and the female pivoting portion 186 includes an upward extending socket. In other embodiments, the male pivoting portion 184 includes an upward extending pivot post and the female pivoting portion 186 includes a downward extending socket. The upper swivel arm 174 additionally includes a locking screw 188 to engage a male pivoting portion of a mounting bracket 176, a smartphone cradle 178, or a tablet cradle 180. The lower swivel arm 172 includes a female pivoting portion at both ends thereof. The lower swivel arm 172 can include a locking screw 188 to engage the male pivoting portion 184 of the upper swivel arm 174 and a locking screw 188 to engage a post 170.

Figure 26:
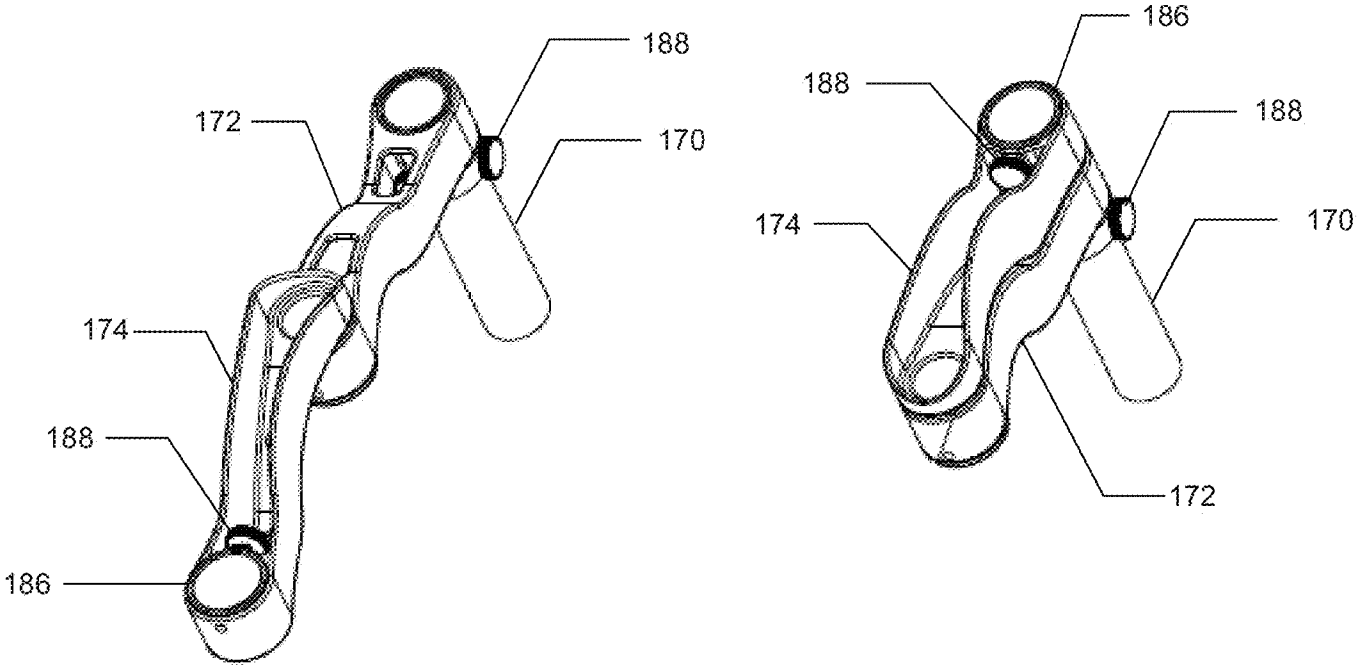
FIG. 26 are perspective views of lower and upper swivel arms for use with the worksurface of FIG. 1.

As also shown in FIG. 26, the swivel arms 172, 174 include a complimentary curved side profile, such that the upper swivel arm 172 is stacked atop the lower pivot arm 174 along the entire length of both swivel arms 172, 174. Power cables or data cables can be inserted through the interior of the post 170, through the interior of the lower swivel arm 172, and through the interior of the upper swivel art 174. As shown in FIG. 28 for example, the interior of the swivel arms 172, 174 can include laterally spaced apart teeth 189 to secure power cables or data cables therebetween, or mounting features 191 (FIG. 27) to secure electrical connectors. The lower and upper swivel arms 172, 174 are substantially identical in length, such that the female pivoting portions 186 of the lower swivel arm 172 are separated by a lateral distance that is substantially equal to the lateral distance separating the male and female pivoting portions 184, 186 of the upper swivel arm 174. In addition, the lower and upper swivel arms 172, 174 include substantially flat vertical sidewalls 190, defining an open interior to improve rigidity and reduce material costs. The sidewalls 190 terminate at rounded end portions that extend around the male and female pivoting portions 184, 186.

Figure 29:
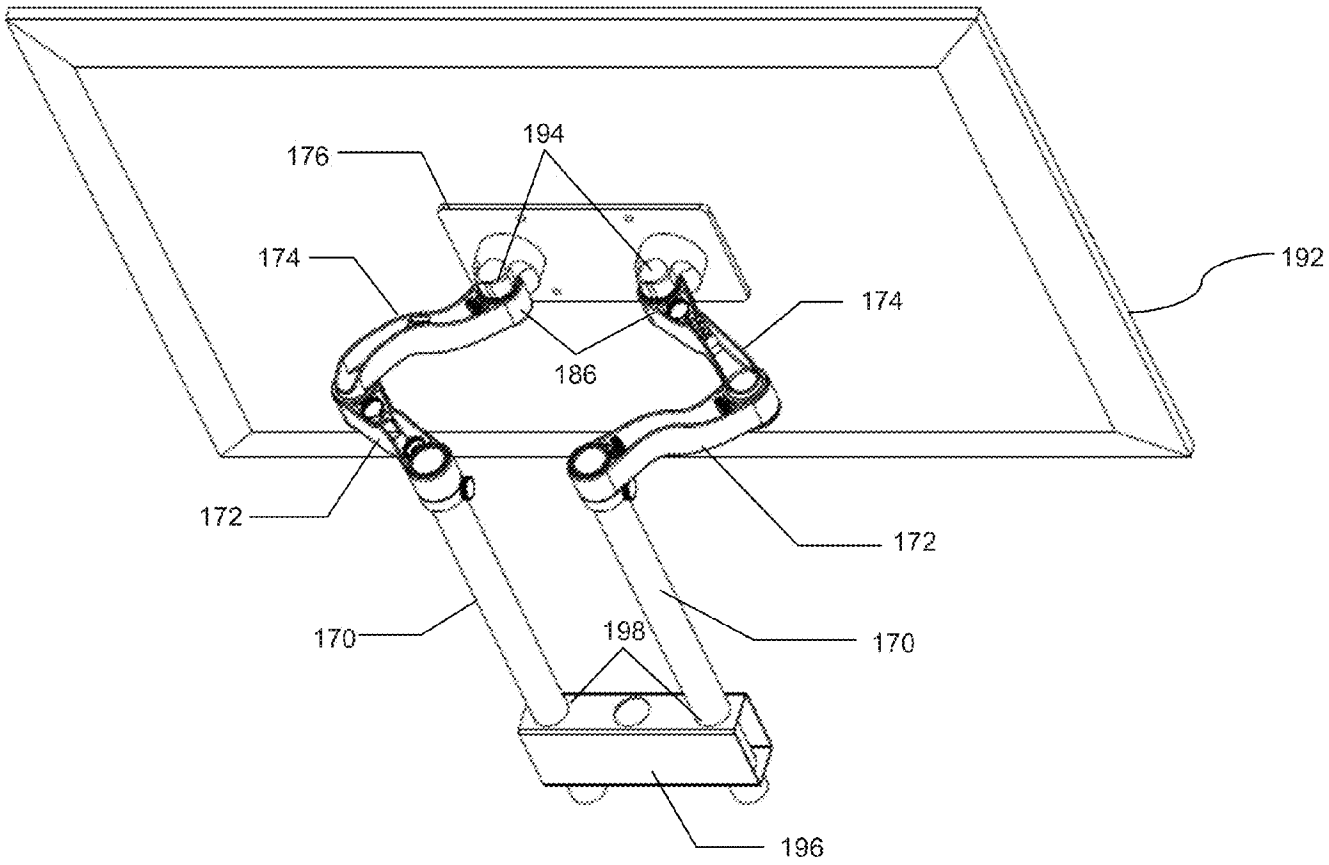
FIG. 29 is a perspective view on the lower and upper swivel arms of FIGS. 26 through 28 as supporting a large flat screen monitor.

As further shown in FIG. 29, the lower and upper swivel arms 172, 174 can be used in combination with a mounting bracket 176 for a monitor, for example a flat screen liquid crystal display 192. The mounting bracket 176 includes multiple sets of apertures (for example VESA hole patterns) for attachment to different size monitors. The mounting bracket 176 includes first and second male pivoting portions 194 extending into first and second female pivoting portions 186 of respective first and second upper 174 swivel arms. The lower and upper swivel arms 172, 174 are suspended above the worksurface 22 atop first and second posts 170. The posts 170 extend through a stabilizing channel 196 that is positioned at or above the worksurface 22. The channel 196 includes a closed cross-section for improved rigidity and includes vertically-oriented apertures 198 to allow the first and second posts 170 to extend therethrough. The apertures 198 are in general alignment with the vertical openings 46 in the worksurface 22, such that the posts 170 extend through the apertures 198 and into the vertical openings 46 in the worksurface 22.

Figure 30:
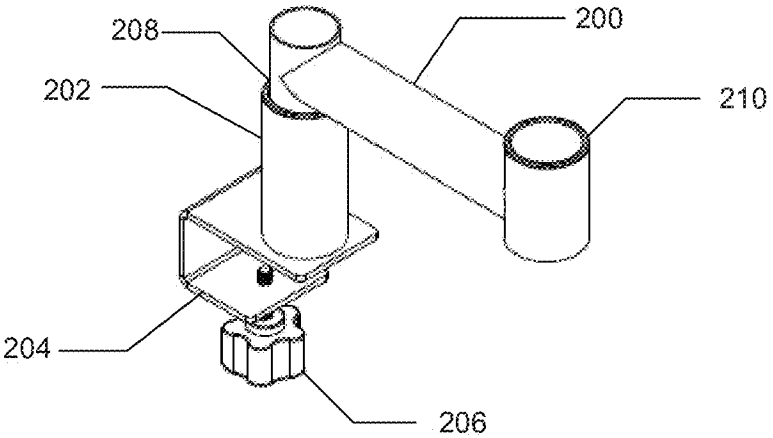
FIG. 30 illustrates an alternative swivel arm and a c-clamp bracket for the worksurface of FIG. 1.

As alternatively shown in FIG. 30, a swivel arm 200 is received within a socket 202 extending upwardly from a c-clamp bracket 204. The c-clamp bracket 204 includes a C-shaped cross-section adapted to fit over the side edge of the worksurface 22. The c-clamp bracket 204 includes a tightening screw 206 to engage the underside of the worksurface 22. The swivel arm 200 differs from the swivel arms 172, 174 noted above in that the swivel arm 200 includes a tubular cross-section. The swivel arm 200 is otherwise similar to the swivel arms 172, 174. The swivel arm 200 includes a male pivot portion 208 and a female pivot portion 210. The male pivot portion 208 includes a downward extending pivot post, and the female pivot portion 210 includes an upward-opening socket. The outer diameter of the male pivot portion 208 is approximately identical to the inner diameter of the female pivot portion 210, such that additional swivel arms 200 can be coupled to each other as generally shown in FIG. 29.

Figure 31:
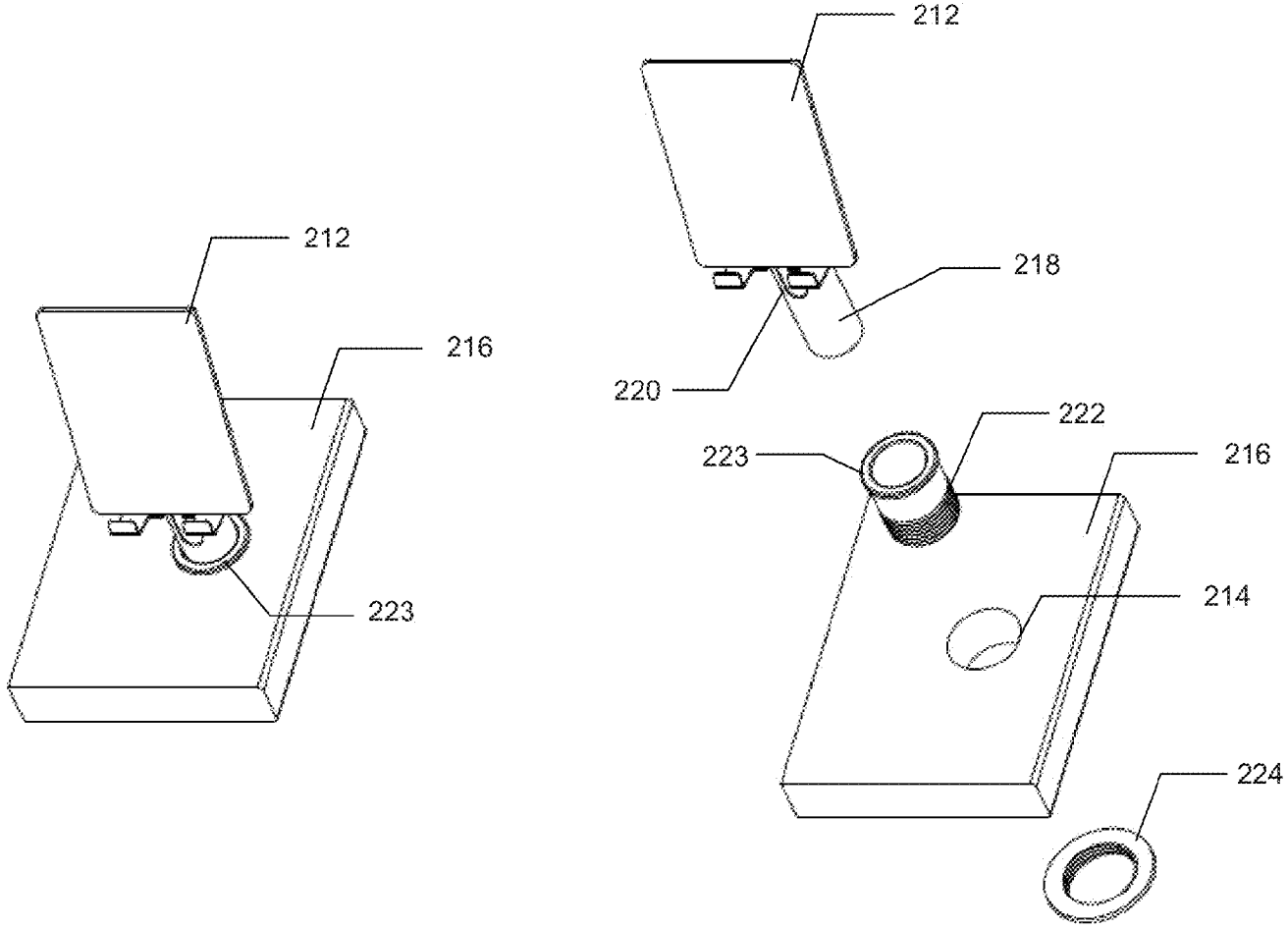
FIG. 31 illustrates a threaded sleeve and a collar for securing a device holder to a worksurface having a vertical opening.

As further alternatively shown in FIG. 31, a smartphone cradle 212 (item 92 in FIG. 14 and item 178 in FIG. 25) can be received in a through-hole 214 in a worksurface 216. The cradle 212 includes a downwardly extending post 218 having an outer diameter less than the inner diameter of the through-hole 214. The post 218 includes an opening 220 in its cylindrical sidewall to allow the power cables and/or data cables there-through. The post 218 extends through an externally-threaded sleeve 222. The externally-threaded sleeve 222 includes an inner diameter approximately equal to the outer diameter of the post 218 (and identical to the opening 46 in FIG. 2) and includes an outer diameter approximately equal to the inner diameter of the through-hole 214. The sleeve 222 also includes a lip 223 having an outer diameter greater than the inner diameter of the through-hole 214. The sleeve 222 maintains the angular position of the cradle 212 by friction generated by the internal surface of the sleeve 222 engaging the external surface of the post 218 and maintains the vertical position of the cradle 212 with a stop lip at the bottom of the sleeve 222. An internally-threaded nut 224 is adapted to screw onto the externally-threaded sleeve 222 from beneath the worksurface 216 to prevent the undesired removal of the externally threaded sleeve 222. Though shown as a smartphone cradle in FIG. 31, the cradle 212 can be configured for other devices, including tablet computers as shown in FIG. 25.

Figure 33:
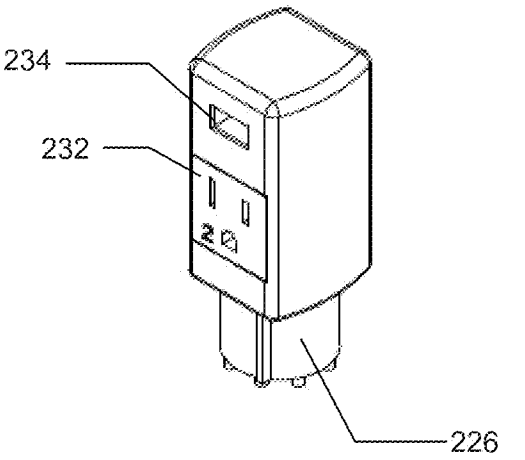
FIG. 33 is a perspective view of a second power strip for use with the worksurface of FIG. 1
Figure 32:
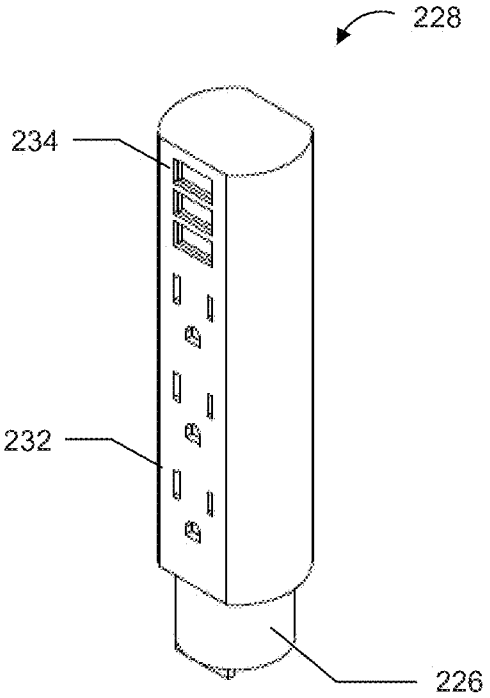
FIG. 32 is a perspective view of a first power strip for use with the worksurface of FIG. 1.
Figure 34:
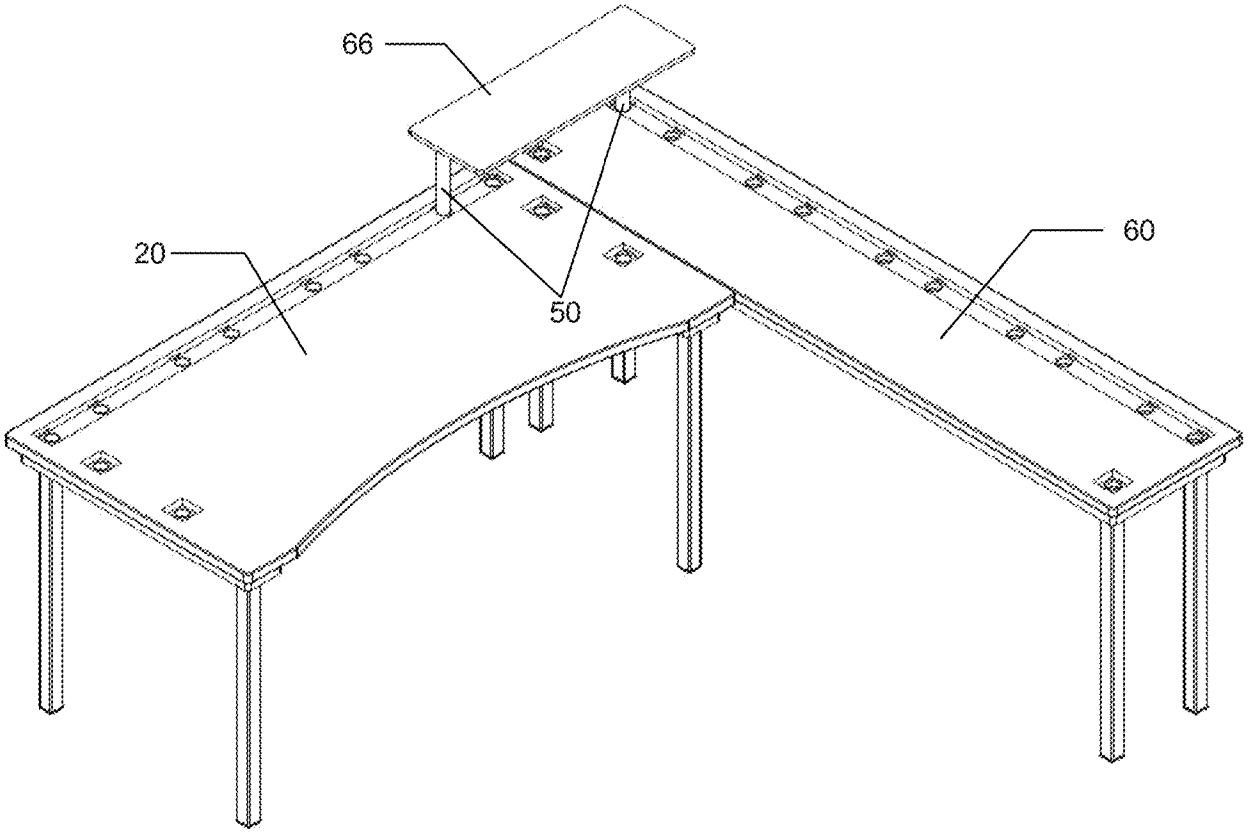
FIG. 34 is a perspective view of an elevated support stand spanning a desk and a side table.
Figure 35:
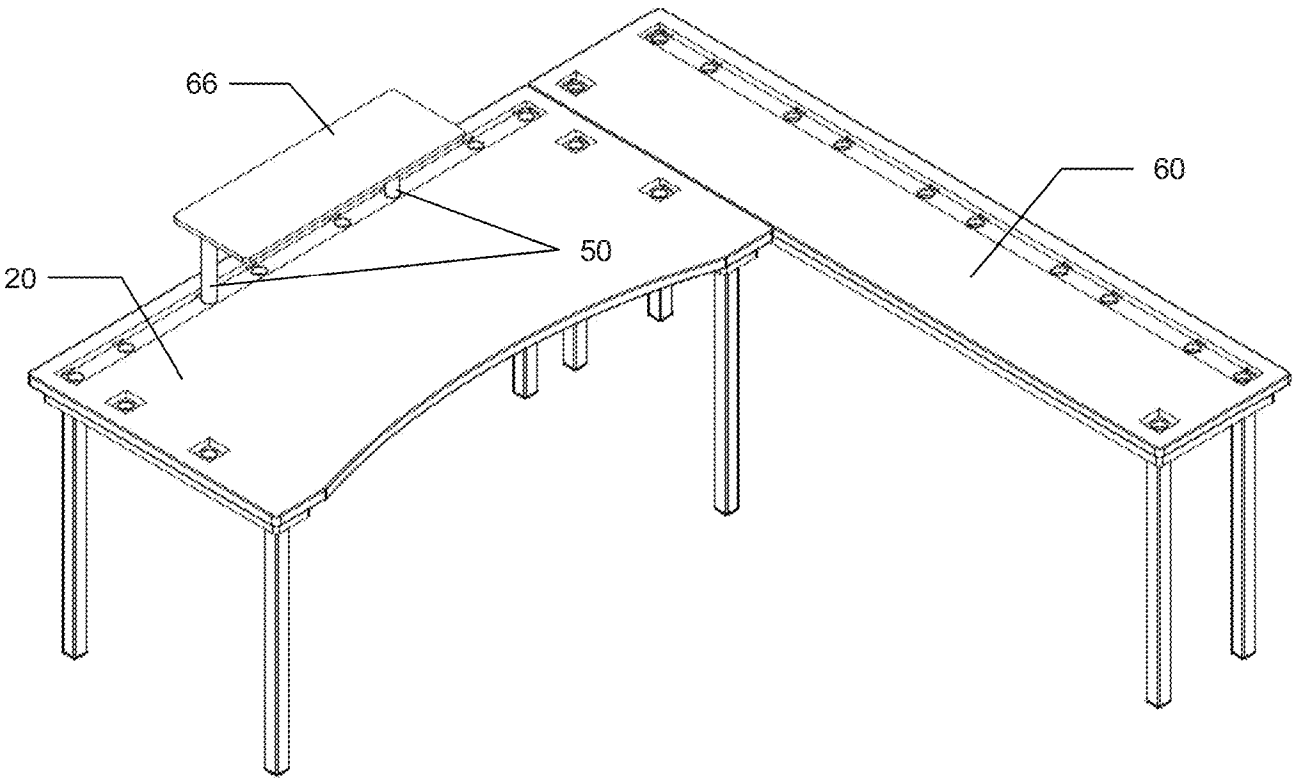
FIG. 35 is a perspective view of an elevated support stand supported by a desk adjacent to a side table.
Figure 36:
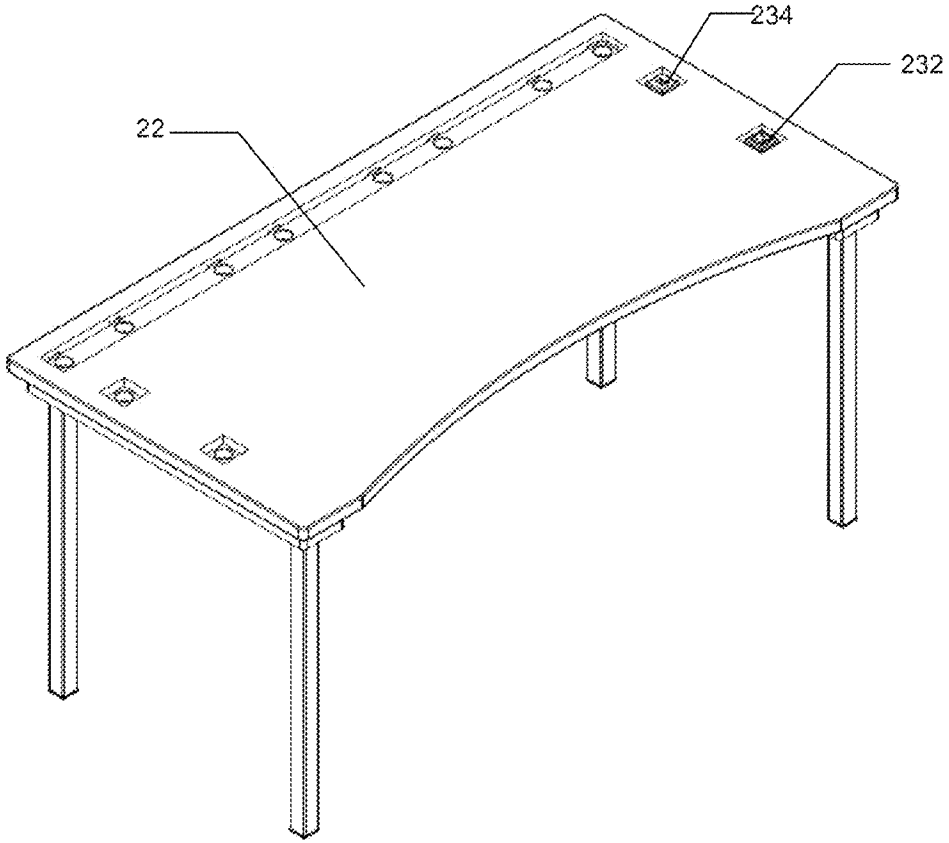
FIG. 36 is a perspective view of a desk having a USB outlet and a power outlet in place of vertical openings.

Electrical outlets are also provided for use in connection with the worksurface 22. The electrical outlets can be shaped to be received within the openings 46 in the worksurface 22. As shown in FIGS. 32 and 33 for example, the lowermost portions 226 of the electrical outlets 228, 230 are sized to be received within the vertical openings 46 in the worksurface 22. The electrical outlets 228, 230 can extend vertically above the worksurface 22, and can include 120 V AC sockets 232 and USB power ports 234, for example. The 120 V AC sockets 232 and USB power ports 234 can also be recessed or generally flushed with the worksurface 22 as shown in FIG. 36. The electrical outlets 228, 230 are coupled to a mains voltage from beneath the worksurface 22, optionally using the desk wire tray 140 of FIG. 19 above. Alternatively or additionally, the posts 170 include a hollow interior channel to allow the passage of power cables and/or data cables therethrough. The electronic devices can therefore receive power through cables carried within the posts 50, 94, 170, 218 and optionally within the swivel arms 174, 174, rather than from the electrical outlets 228, 230.

Figure 37:
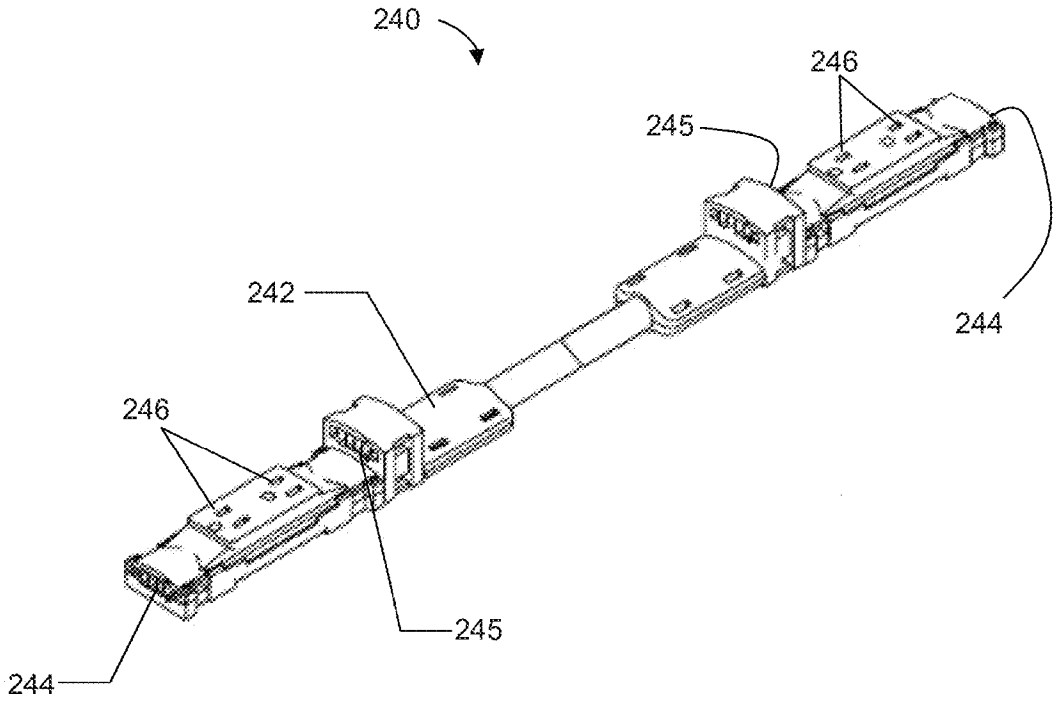
FIG. 37 is a perspective view of a power module for attachment to the underside of a worksurface.

Electrical outlets are also provided beneath the worksurface 22. The electrical outlets can include (a) a 120V six-outlet power strip is strip with an 8" cord, (b) a 120V two-circuit modular power strip, (c) a 50 watt, 6 port, USB charger with 10 watts max per port, (d) a 250 watt, 8 port, USB charger with 100 watts max per port, and/or (e) a USB 3.0 data hub providing a 250 watt charging capacity. As shown in FIG. 37, for example, a power module 240 is illustrated, the power module 240 including a rigid housing 242 with two outer sockets 244 and two inner sockets 245 for receiving a power cable (e.g., a jumper cable or a flex cable). The two outer sockets 244 are at opposing end portions of the power module 240, and the two inner sockets 245 are positioned nearer to the middle of the power module 240. Once any one of the sockets 244, 245 receives a power cable, the module 240 has power and four standard outlets 246 are live. By including four power sockets 244, 245 at generally equally spaced intervals, the power module 240 is compatible for use under the desk 20 and the side table 60.

Figure 38:
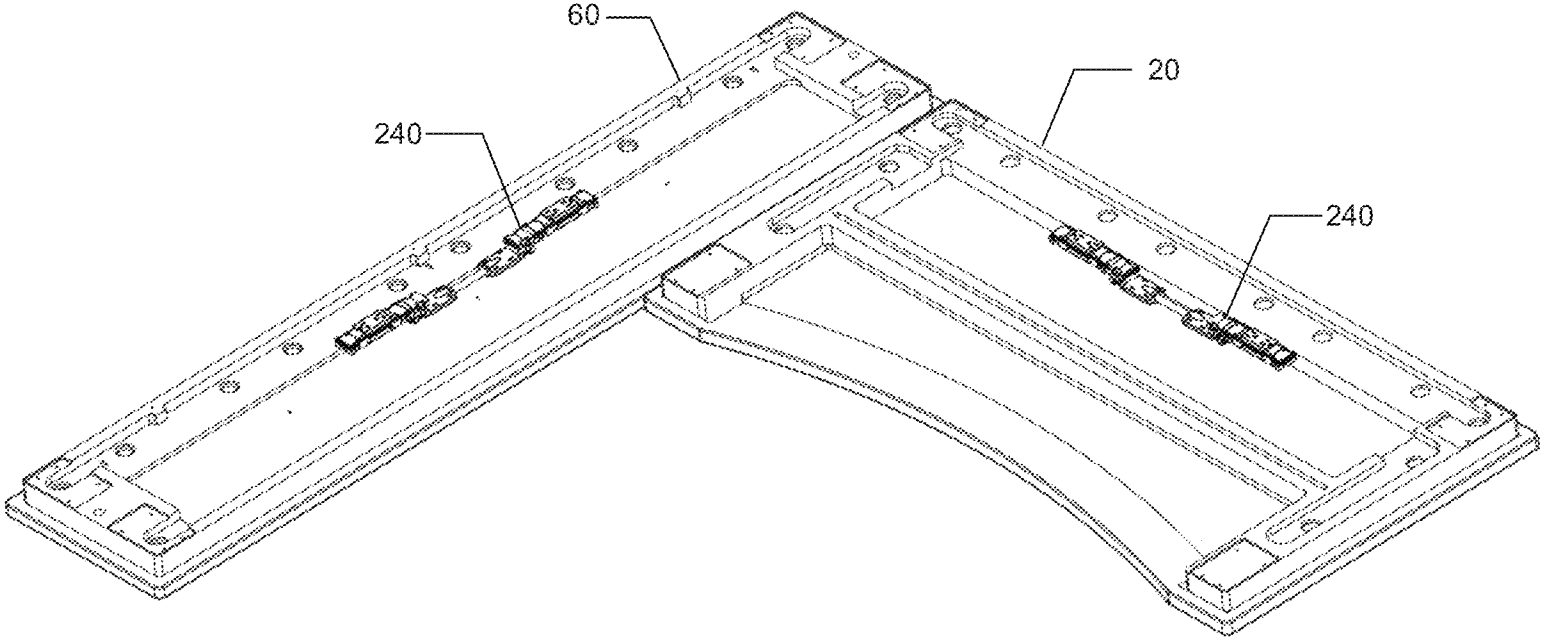
FIG. 38 is a perspective view of an inverted main table and side table including respective power modules.
Figure 39:
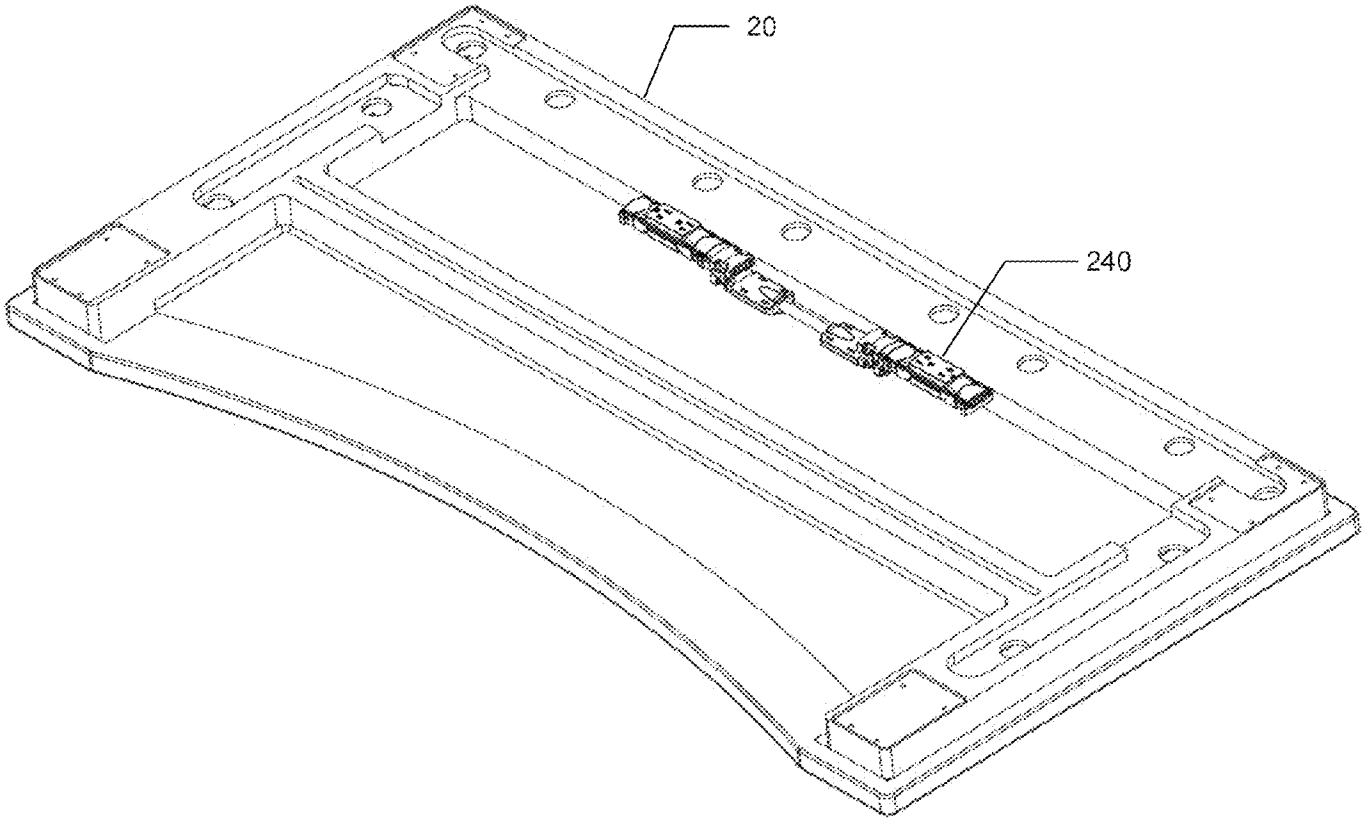
FIG. 39 is a close-up perspective view of the inverted main table of FIG. 38.
Figure 40:
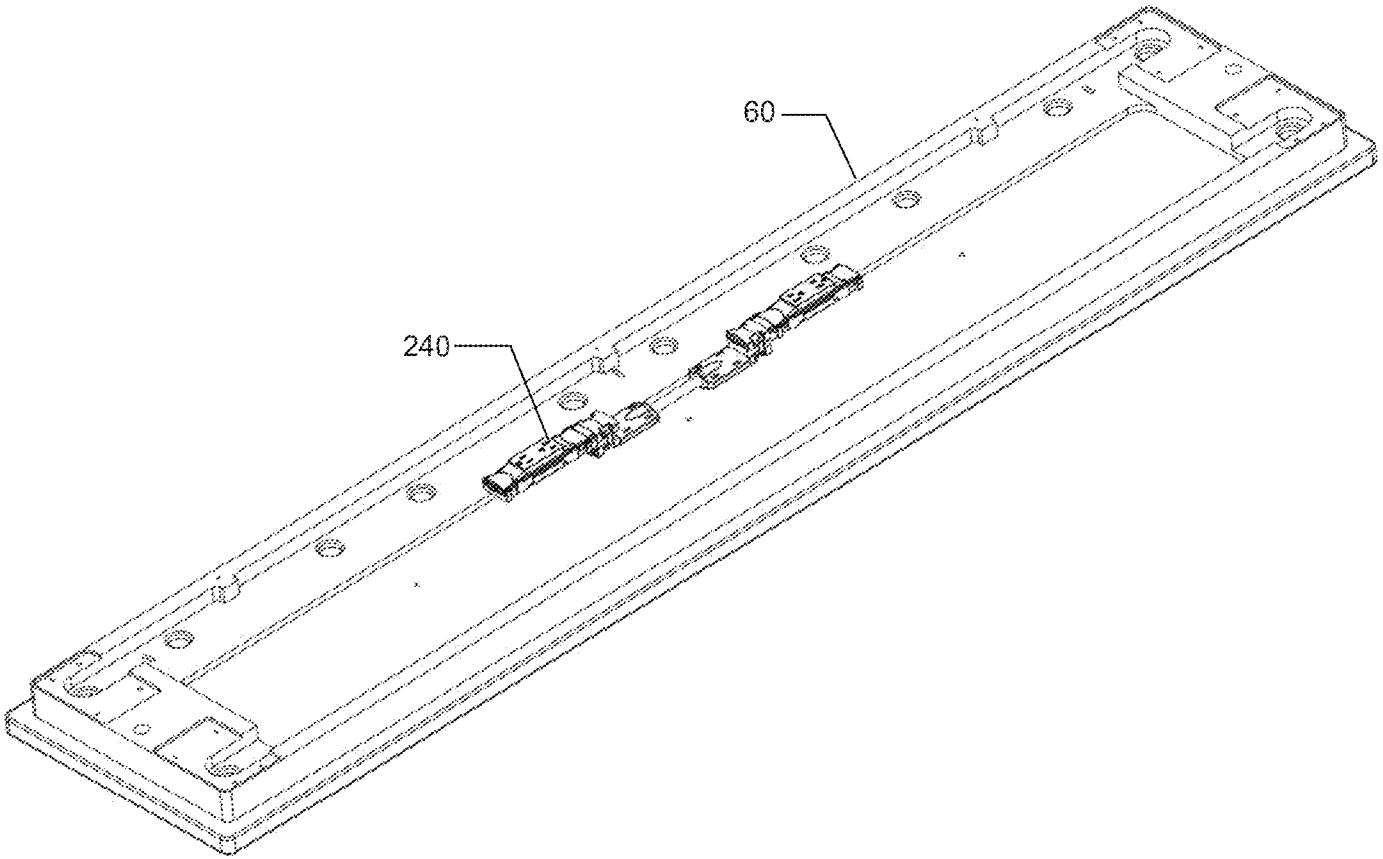
FIG. 40 is a close-up perspective view of the inverted side table of FIG. 38.

The power module 240 is further illustrated in FIGS. 38-40. A single-length power cable can be used for the desk 20 and the side table 60, despite the desk 20 and the side table 60 having a different overall length. That is, a single-length power cable can reach the inner sockets 245 when under the shorter-length desk 20, and can also reach the outer sockets 244 when under the longer-length side table 60. The distance separating the outer socket 244 from the nearest inner socket 245 is one-half of the difference between the length of the desk 20 and the length of the side table 60.

To reiterate, the same power module 240 can be joined to the underside of a desk 20 (FIGS. 38 and 39) and the underside of a side table 60 (FIGS. 38 and 40). Two sockets 244 are disposed at the outermost lateral end portions of the power module 240, and two additional sockets 245 are disposed inward of the outermost lateral end portions of the power module 240. As shown in FIG. 3, the two additional sockets 245 are vertically offset from the outermost sockets 244. Each of the electrical outlets 246 are spaced apart along the lengthwise axis of the power module 240. Each of the electrical outlets 246 are "live" (e.g., can provide AC power to one or more electrical devices) when a power cable is electrically coupled to any one of the four sockets 244.

The illustrated embodiments therefore provide a plurality of workspace configurations adapted to support various accessories, including privacy panels, storage accessories, and docking cradles and electrical devices. These accessories are supported in one or more vertical openings or lateral retention slots within the worksurface. The user can reposition the accessories as desired, optionally without the use of tools, thereby providing enhanced flexibility and customization over existing furniture constructions.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. Any reference to elements in the singular, for example, using the articles "a," "an," "the," or "said," is not to be construed as limiting the element to the singular.

The invention claimed is:

1. A furniture unit comprising:

a worksurface; and a desk wire tray below the worksurface, the desk wire tray including:

a wire management channel including a central portion to supportably receive one or more wires thereon, a first hinged connection to releasably join the wire management channel to the worksurface, and a second hinged connection to releasably join the wire management channel to the worksurface, wherein the wire management channel is adapted to be selectively pivoted about the first hinged connection and about the second hinged connection, such that the central portion of the wire management channel pivots relative to the worksurface to provide dual-sided access to an interior of the desk wire tray from beneath the worksurface.

2. The furniture unit of claim 1 wherein the first and second hinged connections each include a fixed portion connected to an underside of the worksurface.

3. The furniture unit of claim 1 wherein the first and second hinged connections include pivot pins extending from lateral side portions of the wire management channel.

4. The furniture unit of claim 3 further comprising a locking mechanism to actuate the pivot pins between a retracted position and an extended position.

5. The furniture unit of claim 1 wherein the central portion of the wire management channel is a bottom panel, the wire management channel further including first and second side panels.

6. The furniture unit of claim 5 wherein the first and second side panels are removably coupled to the worksurface about the first and second hinged connections, respectively.

7. The furniture unit of claim 1 wherein the worksurface defines a length, and wherein the desk wire tray is coextensive in length with the worksurface.

* * * * *